United States Patent [19]

Constantin et al.

[11] Patent Number: 5,014,501

[45] Date of Patent: May 14, 1991

[54] CARTONING MACHINE, FOR AUTOMATICALLY PLACING AN ARTICLE, IN PARTICULAR A BOTTLE, INTO A BOX

[75] Inventors: Daniel Constantin; Jean-Jacques Fert, both of Paris; Francine Mettivier, Cormeilles, all of France

[73] Assignees: L'Oreal, Paris; Etablissements Albert Aucouturier, Montreuil, both of France

[21] Appl. No.: 444,199

[22] Filed: Dec. 1, 1989

[30] Foreign Application Priority Data

Dec. 2, 1988 [FR] France ..... 88 15847

[51] Int. Cl.[5] ..... B65B 11/28; B65B 21/24

[52] U.S. Cl. ..... 53/173; 53/242; 53/253; 53/564

[58] Field of Search ..... 53/564, 252, 253, 251, 53/250, 249, 449, 242, 173, 170

[56] References Cited

U.S. PATENT DOCUMENTS

| | | | |
|---|---|---|---|
| 3,306,001 | 2/1967 | Peppler | 53/449 |
| 3,388,528 | 6/1968 | Croall et al. | 53/253 |
| 4,350,002 | 9/1982 | Focke | 53/449 |
| 4,918,906 | 4/1990 | Ako | 53/449 |

FOREIGN PATENT DOCUMENTS

| | | | |
|---|---|---|---|
| 2008235 | 9/1971 | Fed. Rep. of Germany | 53/253 |
| 1269377 | 7/1969 | United Kingdom . | |

*Primary Examiner*—James F. Coan

*Attorney, Agent, or Firm*—Cushman, Darby & Cushman

[57] ABSTRACT

The apparatus has, at a first level (N1), a turntable (4) mounted to rotate about a substantially vertical axis (5) and including receptacles (9) distributed over its periphery to receive boxes (2) during passage past a first work station, and for moving them incrementally, in the course of the rotation of the turntable, to various successive work stations, and, at a level (N3) different from the first, a conveyor (A) for moving the article to a station, vertically below a box (2) in the open state, a displacement device (169) being further provided to introduce the article (1) into the box (2) by a substantially vertical motion, and, at an intermediate level (N2) located between the level (N1) of the boxes and the level (N3) at which the articles are supplied, a stack of precut sheets (17) of corrugated cardboard (3) is provided and a suction device for grasping the sheets (17) one at a time for introducing them into a shaper device (18) provided at the intermediate level (N2), in correspondence with each receptacle (9) of the turntable.

16 Claims, 12 Drawing Sheets

5
4
6
N1
10
9
8
25
26
7
10
A
21
27
B
26
25
24
20
12
11
67
30
13
14
28
22
16
19
18
23
N2
30
31
28
29
15
d
34
33
32

FIG. 11
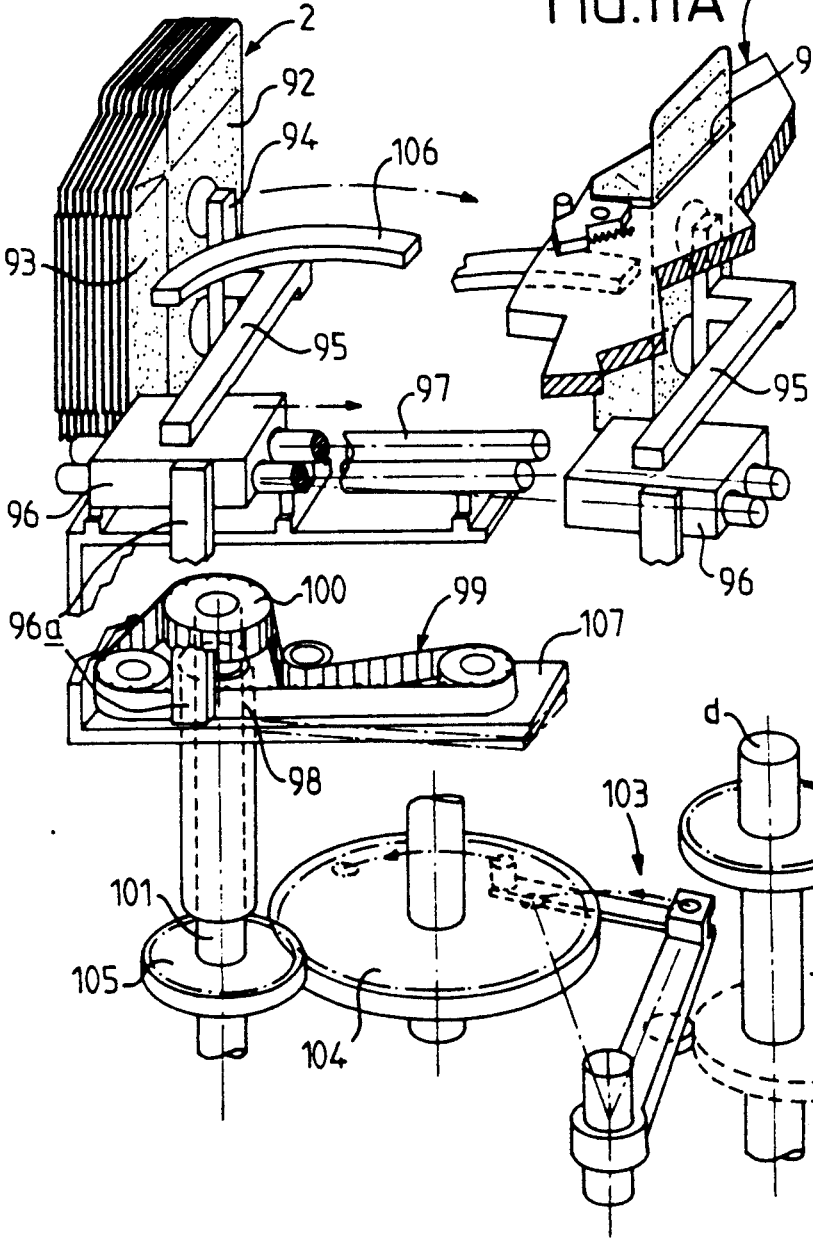
FIG.11A
FIG. 12
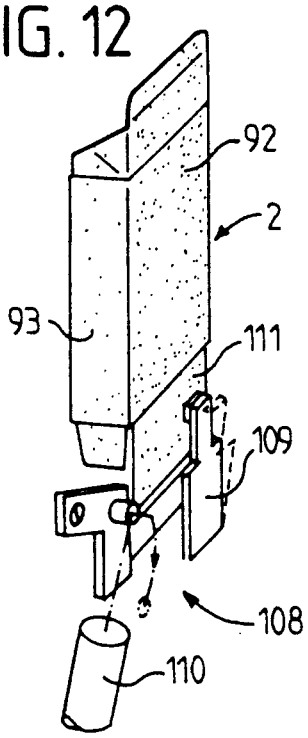

CARTONING MACHINE, FOR AUTOMATICALLY PLACING AN ARTICLE, IN PARTICULAR A BOTTLE, INTO A BOX

FIELD OF THE INVENTION

The invention relates to a machine for automatically placing an article in a box.

BACKGROUND

More particularly, the invention includes a cartoning machine intended to place a bottle in a box automatically. The presently known automatic machines of the type specified above are relatively bulky and are generally designed to function at high speeds, for example greater than 40 strokes per minute. Such machines use complicated mechanisms and they subject both the articles, in particular bottles, and the boxes to constraining motions that can cause scratches on the fragile articles or boxes to be manipulated; this applies particularly to boxes covered with uncoated paint.

Furthermore, when the size of the article changes, machines presently in existence require a relatively long time to be adapted to the new size.

SUMMARY OF THE INVENTION

The object of the invention is above all to furnish a machine, in particular a cartoning machine, of the type specified above, which is compact, has a lightweight mechanical design, and has great flexibility, in order to make rapid changes in size.

The machine must furthermore assure the gentlest possible handling of the article, in particular the bottle, without impacts or bumps of any kind.

According to the invention, a machine, in particular a cartoning machine, for automatically placing an article, in particular a bottle, into a box, is characterized in that it includes, at a first level, a turntable mounted to rotate about a substantially vertical axis and including receptacles distributed over its periphery to receive the boxes for passage past a work station, and for driving them incrementally, in the course of the rotation of the turntable, to various successive work stations, and, at a level different from the first, means for moving the article to a station, vertically of a box in the open state, displacement means being further provided to introduce the article into the box by a substantially vertical motion. With such an arrangement, the article, in particular the bottle, is manipulated in its natural position, without being subjected to impacts or rough movements. This vertical arrangement, with superposition of the level reserved for the boxes and the level for supply of the articles, makes it possible to attain a compact machine, with a footprint of reduced size on the floor, in particular less than 0.8 m×0.9 m.

Preferably, the level of the boxes is located above the level at which the articles are supplied, and the displacement means are arranged to vertically raise the articles and assure their introduction into the box.

Very often, particularly in the case of bottles, a sheath of corrugated cardboard or of some cushioning material surrounds the article inside the box, to protect it against shock; the machine according to the invention also enables automatic introduction of this corrugated cardboard sheet into the box. To do so, at an intermediate level located between the level of the boxes and the level at which the articles are supplied, the machine includes a magazine intended to receive a stack of precut sheets of corrugated cardboard and means for grasping the sheets one at a time and introducing them into a shaper device provided at the intermediate level, in correspondence with each receptacle of the turntable. Preferably, the intermediate level is located beneath the level of the boxes and above the level at which the articles are supplied.

Each shaper device is mounted to slide vertically on guide columns extending from the lower portion of the intermediate level to the lower portion of a receptacle of the turntable, while a fixed ascending ramp is provided to act upon a roller or the equivalent, connected to the shaper and assuring an ascent in the vertical direction of this shaper, in a predetermined angular zone.

Advantageously, the upper end of the shaper is provided with elastic panels converging toward the top in such a manner as to form a kind of funnel, which facilitates the entry of the shaper into the lower opening of the box. The shaper may comprise a parallelepiped cage, the vertical face of which located radially outward with respect to the vertical axis of the machine is open, the lower portion of this cage being open, as is the upper portion which is topped with the elastic panels forming the funnel, the whole being such that the introduction of the precut sheet of corrugated cardboard into the shaper is effected in the radial direction by the action of grasping means which press the sheet against the large vertical face of the shaper that is closest to the axis of the machine, the lateral walls of the shaper and the edge of the funnel holding the lateral portions of the precut sheet and its upper portion folded down, supplementary means being further provided to fold a front flap and a lower flap of the corrugated cardboard sheet.

Preferably, the grasping means of the corrugated cardboard sheets includes a suction device supported by a vertical column provided at its base with a sliding block guided along a diametral rib provided on a tray arranged to be driven in rotation about a vertical axis, means being provided to displace said column in translation along the direction of the rib, while means are provided to drive the tray in rotation about its axis.

The means for driving the column in translation may include a horizontal arm located above the tray and provided with a vertical sleeve traversed freely in rotation by the column, the movements of this arm being controlled by a rotary shaft coaxial with the tray via suitable transmission means, while the tray is in turn driven in rotation from a hollow shaft that is coaxial with the aforementioned shaft. The rotation of each of the shafts may be assured by a wheel driving a pinion wedged onto the respective shaft, and a connecting rod and crank system driving the wheel in response to the rotation of a cam.

The machine includes means for storing the boxes flat, these boxes having a folded closed contour, grasping means being provided for grasping the boxes one by one, while a pushing device, in particular embodied by a ramp, is arranged to act upon one side of the flattened box, while it is driven, to bring about the shaping of this box, the grasping means being mounted on a carriage that is movable in translation and arranged to engage the box in a receptacle of the turntable.

The carriage bearing the grasping means is displaced by an alternating rectilinear motion, by being connected to a rectilinear side of a timing belt which describes a closed contour, this belt being driven by an alternating motion from a pinion which in turn is controlled by a wheel responding to the rotation of a cam.

Preferably, the machine includes a supply conveyor for the articles to be introduced into the boxes, and each article to be introduced is disposed in a bucket provided with an opening in its bottom and disposed on the conveyor, means for pickup of the bucket being provided to disengage it from the conveyor and move it to a station for introduction of the article into the shaper.

The means for introducing the article into the shaper are arranged so as, in a first period of time, to raise the assembly comprising the bucket and the article in such a manner that the article remains guided by the bucket while its upper portion engages the inside of the shaper, and then, in a second period of time, to raise only said article via a pusher which passes through the open bottom of the bucket.

A retaining slat device is provided in order to support the article when the article has been introduced into the shaper and the corrugated cardboard envelope, while tipping rod means are provided to fold the lower flap of the corrugated cardboard sheet to the horizontal, and to support it along with the article when the aforementioned slat is withdrawn; preferably, the corrugated cardboard sheet includes a lower tab, and rocking folder means are provided to raise this tab; advantageously, means are provided for laterally holding the tab during the folding of the tab, and for serving as a stop.

The displacement means, in order to introduce the article into the box, include a pusher that is vertically movable, in particular by the action of a jack acting upon a travel multiplier device, for example with a pinion and timing belt, extraction means being further provided for the descent of the shaper, the upper end of which, in the form of a funnel, has been engaged in the lower portion of the box.

Blade means rotating in a substantially horizontal plane are provided to fold the lower and upper side flap of the box which is located to the rear in the direction in which the box is driven by the turntable; the lower and upper lateral flap of the box, which is located in the front in the direction in which the box is driven, is folded down in the course of this drive motion by coming into contact against a stop, formed in particular by a horizontal ramp.

The machine includes, for the closure of the box, an upper flap and a lower flap that are rotatable about a horizontal axis and are provided with suction devices to close the top and bottom of the box, each flap being combined with an arm arranged to fold the tab provided on the edges of the top and bottom, respectively, to assure the engagement of this tab in the box and its locking.

To facilitate the introduction of the tab, means are preferably provided for holding the front wall of the box by suction in such a way as to deflect this wall slightly and to facilitate the introduction of the tab, the wall then being relaxed.

To assure gentle ejection of the filled box, a square tipping assembly is provided, one fin of which comes under the box in the vertical position, this assembly being provided with rollers, the axes of which are parallel and located in a vertical plane when the box is received by the square, the assembly tipping over in such a manner that the plane of the axes of the roller assumes a slightly inclined position with respect to the horizontal and permits the emptying by gravity, at reduced speed, of the filled box onto a conveyor.

In addition to the arrangements described above, the invention comprises a certain number of other arrangements to be described in further detail below, in terms of an exemplary embodiment described in conjunction with the accompanying drawings, but this is in no way limiting.

BRIEF DESCRIPTION OF THE DRAWINGS

FIG. 11 is a simplified perspective view, with cutaway portions, of the means provided in station II to pick up the boxes one by one and introduce them into a receptacle of the turntable.

FIG. 11A is a fragmentary perspective view of a box at the end of its introduction into a receptacle of the turntable.

FIG. 12 is a detailed perspective view of a device also provided in station II for marking the lower flap of the box.

Finally.

DETAILED DESCRIPTION OF THE INVENTION

Figure 1:
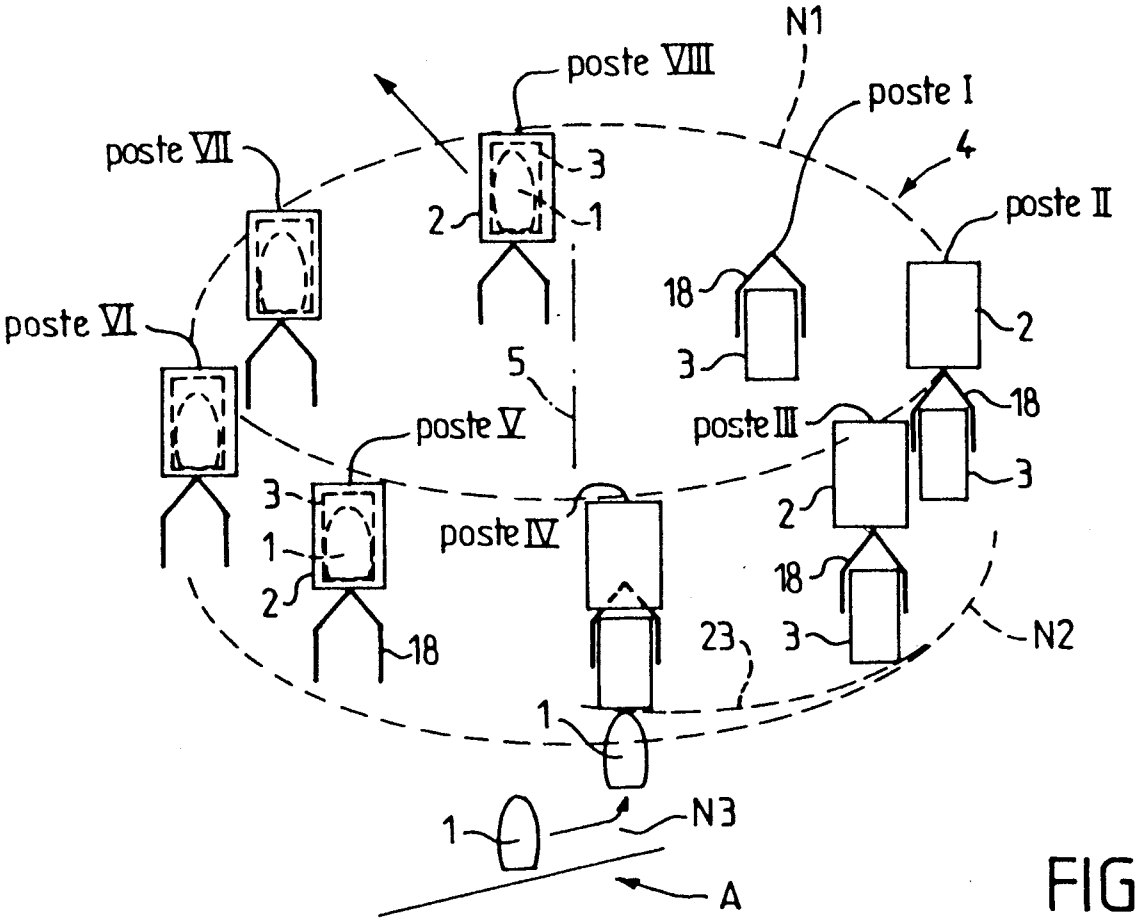
FIG. 1 these drawings is a simplified diagram illustrating the various work stations in incremental succession of a machine according to the invention, and the various operations are performed at each station.

Turning to FIg. 1 of the drawings, a schematic view can be seen of the entire organization of a machine according to the invention, intended for automatically placing a bottle 1 in a box 2. The machine shown in the drawings is furthermore provided to surround the bottle 2 with a sheet of corrugated cardboard 3 intended for protecting the bottle against shock. However, it is clear that the machine can also be suitable if the presence of a sheet corrugated cardboard is not required.

Figures 4, 5, 6:
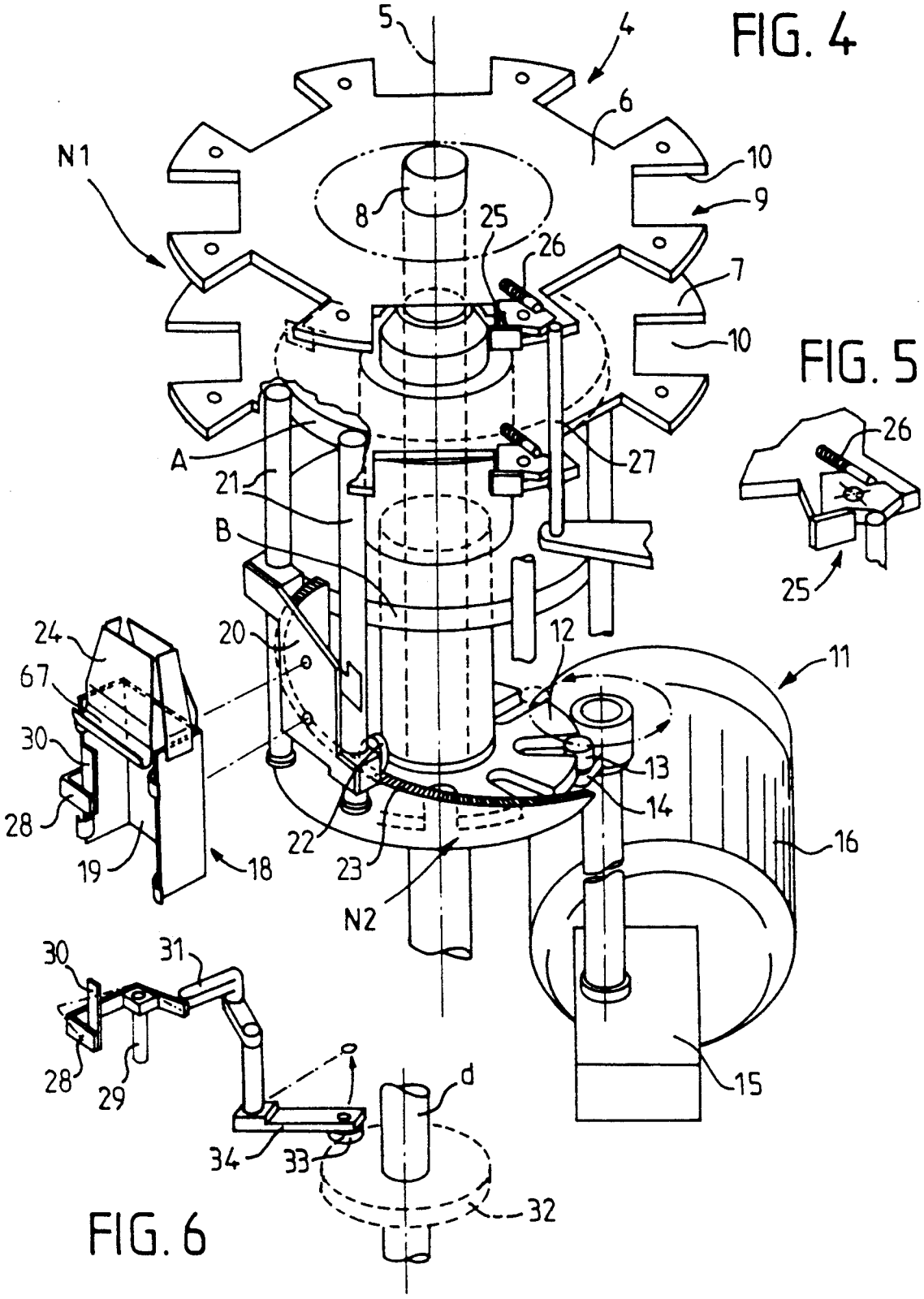
FIG. 4 is a simplified perspective view with cutaway portions, of the main central portion of the machine with the turntable for the boxes.
FIG. 5 is a perspective view on a larger scale of a detail of the device for locking a box in the turntable.
FIG. 6 is a perspective view of the device for controlling the locking of the corrugated cardboard in the shaper.

At a first level N1, represented schematically by a circle of dashed lines in FIG. 1, the machine includes a turntable 4 (see FIGS. 2 and 4) mounted to rotate about a vertical geometric axis 5. As can be seen in FIG. 4, this turntable includes two circular plates 6, 7 that are parallel to and spaced apart from one another in the vertical direction. These plates are wedged for rotation onto a shaft 8 having the axis 5. The turntable 4 includes receptacles 9 distributed at regular intervals over its periphery, to receive the boxes 2; these receptacles 9 comprise recesses 10 of rectangular shape, which open radially outwardly. A recess 10 of the upper plate 6 is located vertically above a recess 10 of the lower plate 7. In the example here, eight receptacles 9, distributed at regular intervals, are provided in the turntable 4.

A mechanism 11 for incrementally driving the shaft 8 is provided in the lower portion of this shaft. This mechanism 11 includes a horizontal disk 12 wedged onto the shaft and provided with eight recesses, with which a lug 13, each time it completes one revolution, cooperates, the lug being driven in continuous rotation by a crank pin 14 rotating about a vertical axis located slightly outside the periphery of the disk 12. The crank pin 14 is driven in continuous rotation by the output shaft of a reducing gear !5, which in turn is driven by an electric motor Each increment effected corresponds to ⅛ a revolution of the shaft 8 and hence of the turntable 4.

Figure 2:
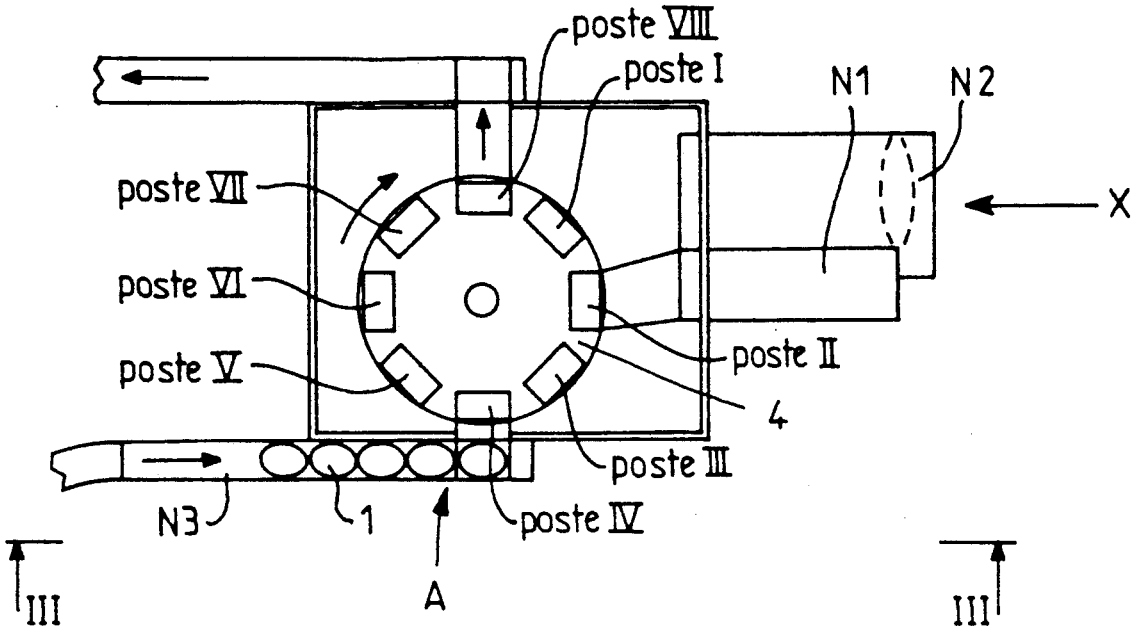
FIG. 2 is a plan view of a machine according to the invention.

Thus each receptacle 9 of the turntable, upon each complete revolution, will move past and stop in front of eight work stations, numbered by Roman numerals I–VIII in FIGS. 1 and 2.

Each receptacle 9 receives one box 2 at the work station II and drives it, in the course of the rotation of the turntable 4 past the various stations III—VIII. The closed box containing the bottle 1 surrounded with the corrugated cardboard 3 is ejected at station VIII.

At a level N3 (FIGS. 1 and 2) lower than the level N1, the machine includes means A for supplying bottles 1 to the Work station IV below and vertically of a box 2 that is located in the open state in this station IV.

At an intermediate level N2 located below the level N1 of the boxes, but above the level N3 where the bottles arrive, the machine includes means for fetching a sheet of shock absorbing material, generally comprising a sheet 17 (FIGS. 3 and 7) of precut corrugated cardboard. After suitable folding, this sheet 17 is intended to be introduced into a box 2 in such a manner as to surround the bottle located inside this box. Fetching of the sheet 17 takes place at the work station I. To do so, at the intermediate level N2, the machine includes one shaper 18 associated with each receptacle 9 of the turntable and located below this receptacle.

As can be seen in FIG. 4, the shaper !8 takes the form of a parallelepiped cage, of which one large vertical face, the one farthest from the axis 5 of the machine, is open. The other large vertical face 19, radially closest to the axis 5, is intended to be affixed, in particular via a fast-action lock, on a plate 20 mounted to slide vertically, guided by two parallel vertical columns 21. These columns, affixed to two trays A and B, extend from the level N2 up to the lower face of the plate 7, corresponding with the recess 10, slightly to the rear radially of the inner edge of this recess. One shaper 18 and two guide columns 21 are thus associated with each receptacle 9.

The sliding plate 20 is provided on its rear face with a shaft carrying a rotating roller 22 arranged to come into contact with a helical ramp 23 that assures the ascent of the plate 20 and shaper 18 in the course of the turntable rotation. The ramp 23 begins at the lower portion of the level N2 and extends toward the work station III; its pitch is selected such that when the shaper arrives at station IV, the upper end 24 of this shaper is engaged in the lower, open portion of the box 2 held in the associated receptacle 9.

This upper end 24 of the shaper is provided with elastic panels forming a kind of funnel, to facilitate the entry of this upper portion into the lower opening of a box 2. This box 2 is held in the corresponding receptacle 9 of the turntable 4 by a clip such as 25 rotatably attached to one edge of each recess 10 of the plates 6 and 7. Each clip 25 is urged by a compression spring 26 to rotate in the direction that assures locking of the box 2 in the receptacle 9, with one portion of the clip then projecting transversely into the opening of the recess 10. The plates of the two clips 25 provided on the same side for each recess 10 of the same receptacle 9 are both actuated by a vertical rod 27 such that by exerting thrust in a suitable direction on this rod 27, the simultaneous opening of the two superimposed clips 25 is brought about. A box 2 is held in a receptacle 9 by chucking of its vertical wall closest to the axis 5 against the bottom of the receptacle 9 defined by the inner edges of the receptacle 9 under the influence of the clips 25, which exert a pressure on the outer face of the box 2.

A cliplike device 28 (FIGS. 4 and 6) articulated on a vertical axis 29 is provided to keep the corrugated cardboard inside the shaper 18. The axis 29 is located closer to the shaft 8 than the bottom 19 of the shaper 18; the clip device 28 is substantially in the form of a U, located in a horizontal plane, and extends beyond a lateral wall of the shaper 18, in such a way as to project transversely over the open face of the shaper 18 when the device is closed; the end of the arm of the clip that projects transversely into this opening is provided with a small vertical plate 30 arranged to exert the chucking force (under the influence of elastic restoring means, not shown) onto the envelope of corrugated cardboard (not shown) that would be located inside the shaper !8. The clip 28 is controlled in the direction of the opening (in the example shown, rotation of the clip 28 clockwise about the shaft 29) by a prong 31, which is capable of rotating about a vertical shaft under the influence of a control cam 32, with a roller 33 pressing against it that is carried by an arm 34 linked rotatably to the prong 31. The arm 34 is urged against the cam 32 by elastic means, not shown.

The profile of the cam 32 is such that for a predetermined angular displacement of the cam, which rotates with the shaft d, the arm 34 and the roller 33 are displaced toward the position indicated in dot-dash lines, rotating counter clockwise; the prong 31 effects a similar motion, pushing on the rear arm of the clip 28, which causes the clip to rotate clockwise about the shaft 29 and releases the chucking action.

Figure 3:
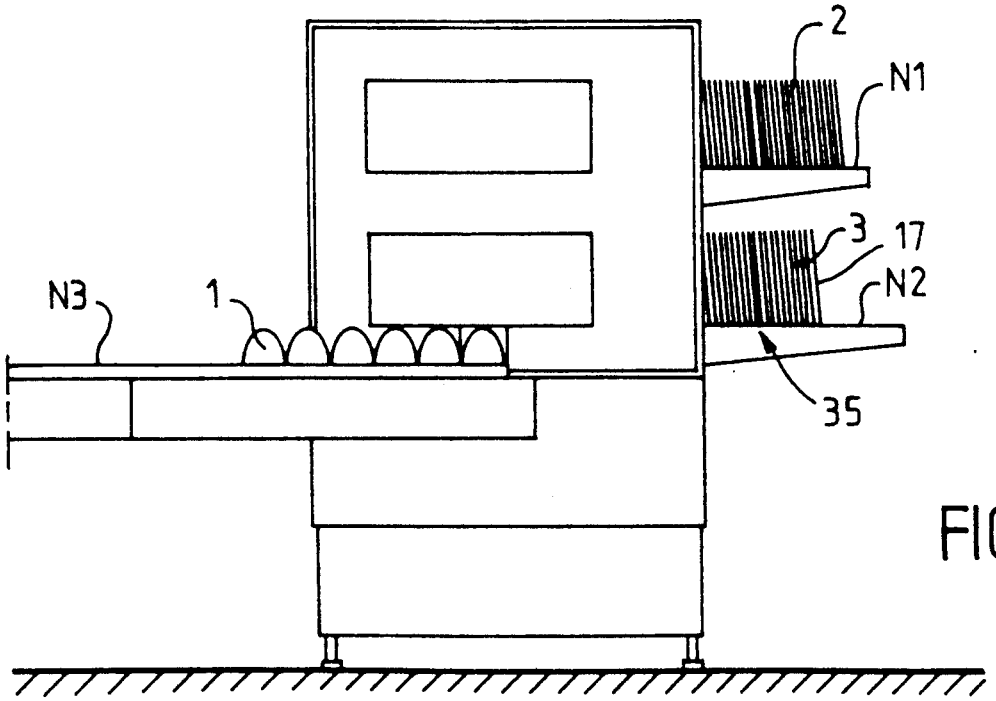
FIG. 3 is an elevation view along the line III—III of FIG. 2.
Figure 7:
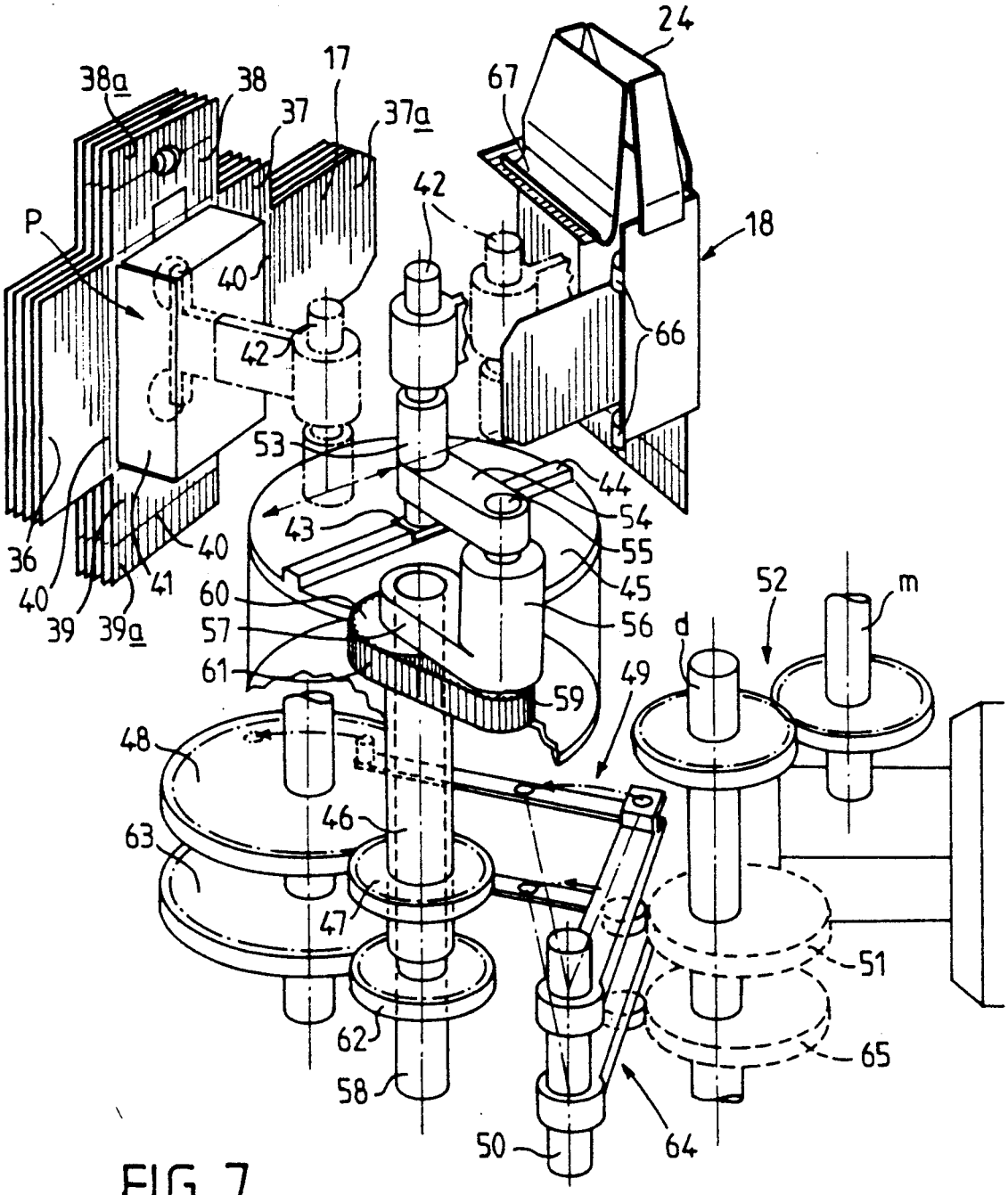
FIG. 7 is a simplified perspective view, with cutaway portions, of a shaper and means for grasping the corrugated cardboard in order to introduce it into the shaper, these means being located radially outward with respect to the turntable and at a lower level than the level of the shapers, vertically of the work station I.

As can be seen in FIGS. 3 and 7, the sheets 17 of corrugated cardboard 3 that are stacked flat on one another, substantially vertically, are provided with storage means, shown schematically. All in one plane, the precut sheets include one large wall 35 in the center, bounded on each side by lateral walls 36, 37 and at the top and bottom by an upper flap 38 and lower flap 39. Each of these flaps is extended by a tab 38*a*, 39*a* intended to be folded up at an angle of 90° with respect to the flap. The lateral flap 37 is lengthened by a slightly narrower front flap 37*a*, intended to be located, after being folded down, parallel to the large wall 35. The folds 40 among the various faces and walls are marked in such a way that the thrusting force is exerted on one wall with respect to another, the folding occurs along the desired line.

Grasping means P are provided to take the sheets 17 one by one and introduce them into the shaper 18. The grasping means include a suction device 41, which is shown in several positions in FIG. 7, in particular the position for engaging a corrugated cardboard 3 in the stack, at top left of FIG. 7, and the position for placement of the corrugated cardboard in the shaper 18, at top right, again in FIG. 7. The device 41 is supported by a vertical column 42 to which it is connected for rotation. This column 42 is provided at its base with a sliding block 43 that is capable of displacement in translation along a guide rib 44 extending along a diameter of a horizontal tray 45. This tray forms the top of a drum having a vertical axis, which may be driven in rotation by a hollow shaft 46 coaxial with the tray 45.

A pinion 47, wedged for rotation onto the hollow shaft 46, meshes with a toothed wheel 48 capable of rotating about a vertical shaft, the diameter of the toothed wheel being greater than that of the pinion. This toothed wheel 48 may be driven in an alternating rotational motion of limited angular amplitude by a connecting rod and crank system 49, the crank of which is controlled to rotate about a vertical axis 50 by a cam 51 that is wedged for rotation onto the shaft d, and which cooperates with a cam follower roller carried by the crank of the system 49.

The shaft d is driven in rotation from the parallel shaft m by a set 52 of pinions that mesh with one another and are wedged onto the shafts m and d, respectively.

The column 42 passes freely in rotation through a sleeve 53 having a vertical axis, provided at one end of a substantially radially extending horizontal arm 54; the other end of this arm 54, located radially on the outside of the tray 45, is blocked in rotation on one end of a vertical shaft 55 extending downward and freely passing rotatably through a sleeve 56 having a vertical axis provided at the end of a crank 57 wedged rotatably on a vertical shaft 58 that is coaxial with both the drum 45 and the shaft 46, and passing through the latter.

At its end located beneath the crank 57, the shaft 55 is provided with a pinion 59 of a diameter smaller than that of a toothed wheel 60 wedged rotatably on the hollow shaft 46, underneath the crank 57. A timing belt 61, in a closed loop, meshes with the pinion 59 and the ring 60. This belt arrangement makes it possible, upon a rotation of the hollow shaft 46, to amplify the angular motion of the arm 54 and to permit a rectilinear path for the shaft 42. The shaft 58 is driven in an alternating rotary motion with the aid of a pinion 62 wedged on this shaft, and a toothed wheel 63 coaxial with the wheel 48 and disposed below it meshes with this pinion. The wheel 63 is driven in an alternating rotary motion of limited angular amplitude by a connecting rod and crank system 64 similar to the system 49, located below the latter, having a crank articulated on the shaft 50. The control of the crank of the system 64 is assured by a cam 65 wedged onto the shaft d, below the cam 5!. The profile of these cams, the characteristics of the connecting rod and crank system, and of the entire transmission assembly are selected in such a way as to produce the following motions at the level of the column 42 and tray 45:

for taking a sheet of corrugated cardboard from the stack, the tray 45 is oriented such that the rib 44 is orthogonal to the median plane of the sheet to be grasped, that is, the rib 44 occupies a position offset by approximately 90° from that shown in FIG. 7; simultaneously, the arm 54 rotates in a direction such that the column 42 is displaced in translation, guided by the sliding block 43 on the rib 44, in the direction of the stack of corrugated cardboard sheets, so that the suction device 41 comes to be pressed against the accessible sheet of the stack; the corresponding position of the column 42 is shown in dashed lines on the left in FIG. 7;

for the removal of the corrugated cardboard sheet, the arm 54 is made to rotate in the direction that brings about the retraction of the column 42 sliding on the rib 44 toward the center of the tray 45; simultaneously, the tray is driven in rotation in the counterclockwise direction, as shown in FIG. 7, about the geometric axis of the sleeve 46 in such a way as to move the rib 44 into the position shown in this FIG. 7 or in other words substantially orthogonally to the open face of the shaper 18, after a rotation of approximately 60° of the drum 45;

the sliding displacement of the column 42 in the direction of the shaper 18, to the position shown in dashed lines on the right in FIG. 7, assures the entry of the corrugated cardboard sheet into the shaper 18, with the large wall 35 of this sheet being pressed against the vertical bottom wall of the shaper 18. In the course of this entry of the corrugated cardboard sheet into the shaper, the lateral flaps 36, 37 are folded down by 90°, toward one another; to facilitate this folding, the vertical edge of each lateral wall of the shaper 18 is provided with ramps 66 embodied by cylindrical surface portions having a vertical generatrix with their convexity facing toward the cardboard.

The lower horizontal edge 67 of the upper portion 24 of the funnel is curved so that its convexity faces toward the bottom. This edge 67 facilitates the introduction of the cardboard into the shaper 18.

Figure 8:
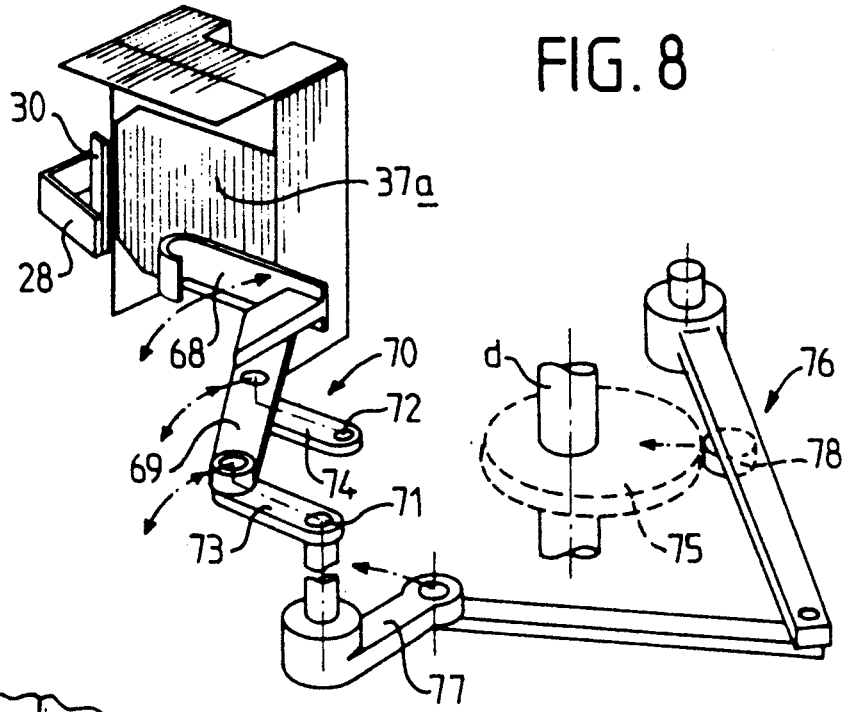
FIG. 8 is a simplified perspective view of the mechanism for folding the front flap of the corrugated cardboard, this mechanism, like that of FIG. 7, being located at the level of station I.

FIG. 8 shows a mechanism for folding down the front flap 37*a* parallel to the large wall 35 of the cardboard. This mechanism is also provided at the station I, but has not been shown in FIG. 7 for the sake of simplification. This mechanism includes a kind of runner 68, the major dimension of which is horizonal and the end of which is intended to press against the flap 37*a* and is curved substantially into a half-cylinder, on the side opposite the flap 37*a*.

This runner 68 is carried by one end of a small horizontal plate 69 comprising one side of a deformable partial parallelogram 70; this small plate 69 is parallel to one fictitious side of the parallelogram, formed by the segment joining the centers of the pivot axes 71, 72 of the other two sides 73, 74. The centers of the axes 71, 72 are fixed in such a way that the small plate 69 on which the ends of the sides 73, 74 are articulated remains parallel to a fixed direction in the course of its being displaced. The other end of the side 73 is wedged rotatably onto the vertical shaft 71. A rotation of limited angular amplitude of the shaft 71 can be controlled by the shaft d via a cam 75 that acts on the crank of a connecting rod and crank system 76. The connecting rod of the system 76 is articulated, at its end remote from the crank, to a radial extension 77 that is fixed to rotate with the shaft 71. Elastic restoring means (not shown) are provided to keep a roller 78 carried by the crank in contact with the periphery of the cam 75.

When the profile of the cam permits the roller 78 to approach the shaft d, as represented by the arrow drawn in dotdash lines, the crank 76 rotates clockwise about its pivot shaft, such that the side 73 turns counterclockwise, which spaces the runner 68 apart from the flap 37*a*.

The folding down of the flap 37*a* is obtained, beginning at the retracted position of the runner 68, by the reverse motion. In the course of this folding operation, the clip 28 is withdrawn outward, to permit the passage of the front flap 37*a* of the cardboard. When the folding is performed, the clip 28 resumes the chucking position and keeps the flap 37*a* folded down.

Figure 9:
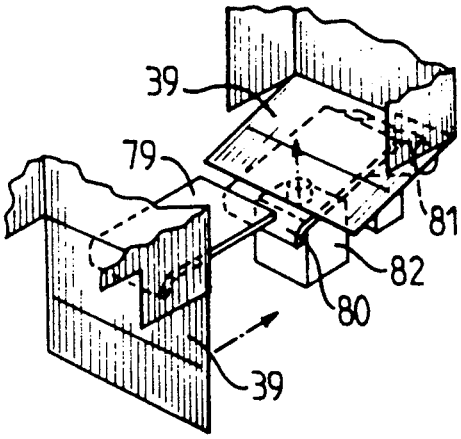
FIG. 9 is a perspective view of a portion of a device likewise provided at station I to fold and crease the lower flap of the corrugated cardboard.

FIG. 9 shows part of a mechanism, also provided at the station I, but not shown in FIG. 7 for the sake of simplification, that makes it possible to crease the lower flap 39 of the cardboard prior to its entry into the shaper 18. This mechanism includes a first ramp 79, the transverse leading edge of which is curved downward. The flap 39 meets this ramp 79 in the course of displacement of the cardboard between storage and the shaper 18; the displacement of the cardboard relative to the ramp 79 brings about the creasing of the flap 39.

A second ramp 80, succeeding the ramp 79 is articulated at the level of its rear transverse horizontal edge 81. A jack 82, in particular using compressed air, is provided to act toward the end of the ramp 80 remote from the edge 81 and raise this ramp so that finally the flap 39 of the cardboard is creased, once the flap is in place in the shaper. Each of the jacks used in the cartoning device of this invention may by air pressure operated.

FIG. 10 shows a mechanism, again provided at the level of the station I, but not shown in FIG. 7 for the sake of simplification, for making a rectangular recess in the median portion of the dihedron formed by the large face 35 of the cardboard and the upper flap 38 that has been folded down before hand by means, not shown.

The edges such as 84 of this recess are cut in the cardboard beforehand, while the folding zones 85 are marked beforehand. The operation comprises transforming the convex dihedron of the median portion defined by the cut edges 84 into a concave dihedron.

Figure 10:
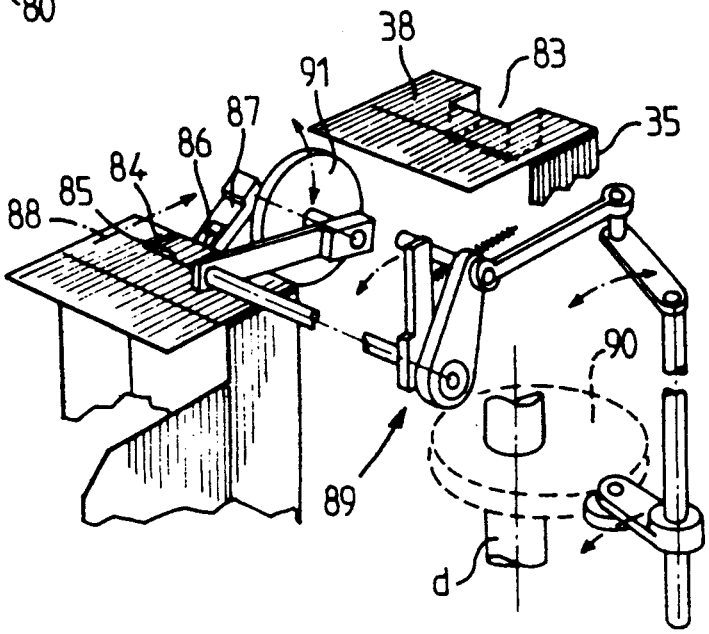
FIG. 10 is a simplified schematic view of a mechanism, also provided at the level of the station I, for shaping the upper portion of the corrugated cardboard.

A roller 86 mounted at the leading end of a part 87 capable of rocking about a horizontal transverse axis is provided to press against and force the vertical face of the convex dihedron, defined by the cut edges 84, in such a way that the convexity is reversed, so that this vertical face becomes horizontal, at the time of the translational displacement of the cardboard along the arrow 88 drawn in dot-dash lines in FIG. 10.

A rod assembly 89, with a return lever, which is clearly visible in FIg. 10, is provided to control the raising of the part 87 by rotation about its axis, so as to cause the roller 86 to pass through the vertical bottom wall of the recess 83 once it has been made. The rod assembly 89 is controlled by a cam 90 wedged onto the vertical shaft d.

A small wheel 91 mounted on the shaft carrying the part 87 is provided so as to be supported on and roll over the upper folded flap 38; the radius of this small wheel 91 is sufficient to keep the roller 86 spaced apart from the folded flap 38.

FIG. 11 shows the mechanism located at station II and at the level N1 making it possible to take the boxes 2 one by one to unfold them and give them a rectangular parallepiped shape, and to introduce them into the receptacle 9 facing the turntable 4.

The boxes 2 are stored vertically and flat, and have a closed contour. In its folded form, the width of the box is greater, because it equals the sum of the width of one large face, such as 92, and one lateral wall, such as 93.

Grasping means include a suction device 94 carried by an arm 95 affixed to a carriage 96 that is movable in translation in a direction that is substantially radial with respect to the turntable 4. This carriage is guided by two parallel cylindrical rods 97.

The carriage 96 is displaced, in an alternating rectilinear movement, by a substantially vertical arm 96*a* to which it is fixed. The lower end of this arm, remote from the carriage 96, is connected to a rectilinear side 98 of a timing belt 99 which describes a closed contour. This belt is driven by a wheel 100 wedged onto a vertical shaft 101, which is driven in an alternating rotary motion from the shaft d, by a cam 102 wedged onto this shaft, in a manner similar to that described above. In other words, the cam 102 acts upon a roller carried by a crank of a connecting rod and crank system 103, which drives a toothed wheel 104, which meshes with a pinion 105 wedged onto the shaft 101.

A thrust device embodied by a ramp 106, the mean plane of which is horizontal and is in the form of an arc of a circle with its convexity facing toward the boxes 2, is provided such that it is fixed with respect to the frame (not shown) of the machine. This ramp is arranged in such a way as to come to interfere with the lateral flattened wall 93 when the suction device 94 drives a box 2 from left to right in FIG. 11. This drive motion, combined with the effect of the thrust of the ramp 106 on the wall 93, causes the formation of the box 2, which from the flattened state becomes a rectangular parallepiped.

The bracket 107 that supports the guide rods of the carriage 96 may, upon assembly, be oriented in an oblique, non-radial positon of the horizontal plane by rotation of its fixation about the axis 101.

This pivoting makes it possible to optimize the path of the transfer of the box with respect to the latches 25 of the receptable 9.

In FIG. 12, a marking device 108 is shown, including a clip 109 controlled by a jack 110, to make a dry indentation on the lower flap 111 of the cardboard box 2.

Figure 13:
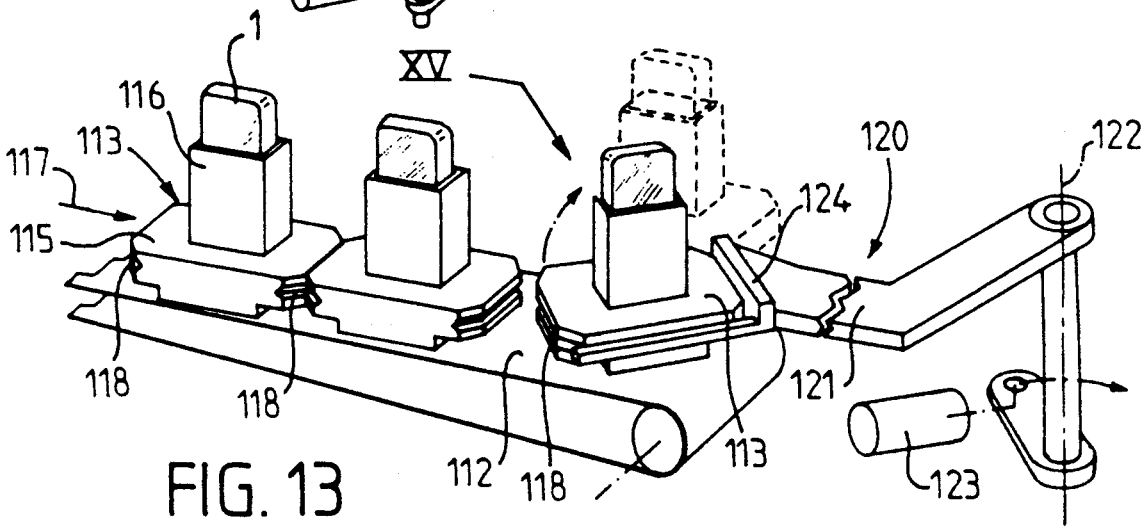
FIg. 13 is a schematic perspective view of one end of a conveyor provided with buckets containing the bottles, with means for grasping these bottles and removing them from the conveyor, at the level of the station IV.

FIG. 13 shows a supply conveyor 112 for the bottles 1 to be introduced into the boxes 2; the supply end of this conveyor is located at the level of station IV. Each bottle 1 is disposed in a bucket 113 provided with an opening 114 in its bottom (see FIGs. 16 and 17).

Each bucket 113 comprises a footing 115 forming a sort of small tray topped with a rectangular parallelepiped envelope 116 open toward the top, and the cross section of which, smaller than that of the tray 115, is provided to receive the bottle 1, with reduced play, the upper portion of the bottle protruding from the envelope 116. The opening 114 is formed by a kind of well that passes through the entire thickness of the fitting 115 and discharges into the envelope 116.

The buckets 113 are driven by the conveyor belt 112 in the direction of the arrow 117 (FIG. 13), that is, from left to right in the view shown in this drawing figure; the front and rear edges of each bucket 113, oriented transversely with respect to the feed direction 117, are provided with a groove 118.

Figure 15:
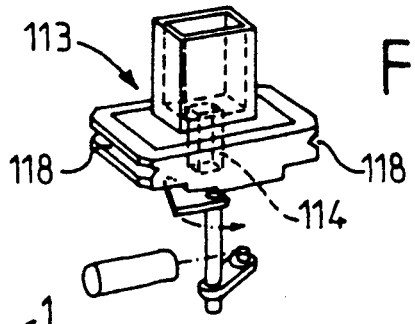
FIG. 15 is a perspective view of a detail in the direction of arrow XV of FIG. 13, these means being provided in station IV.

FIG. 15 shows means for separation of the bucket located the farthest to the right in FIG. 13.

Means 120 (FIG. 13) for pickup of the bucket are provided to disengage it from the conveyor 112 and move it to a station for the introduction, in the vertical direction, of the bottle 1 into the cardboard 3 and shaper 18 containing this cardboard. The mean 120 include a horizontal bent arm 121 mounted to rotate about a vertical axis 122 and controlled by a motive means 123 such as a jack. At its end remote from the axis 122, the arm 121 includes a pickup device 124 having a shape adapted to that of the bucket 113 in such a way as to grasp the bucket 113 in a rotational motion of the arm 121 in the clockwise direction about the axis 122 as seen in FIG. 13, and to drive this bucket 113 outside the conveyor belt 112, while holding the bucket. The arm 121 and the axis 122 are disposed such that when the bucket 113 has left the conveyor 112, it describes a motion of circular translation tangent to the horizontal direction orthogonal to the arrow 117.

Figure 14:
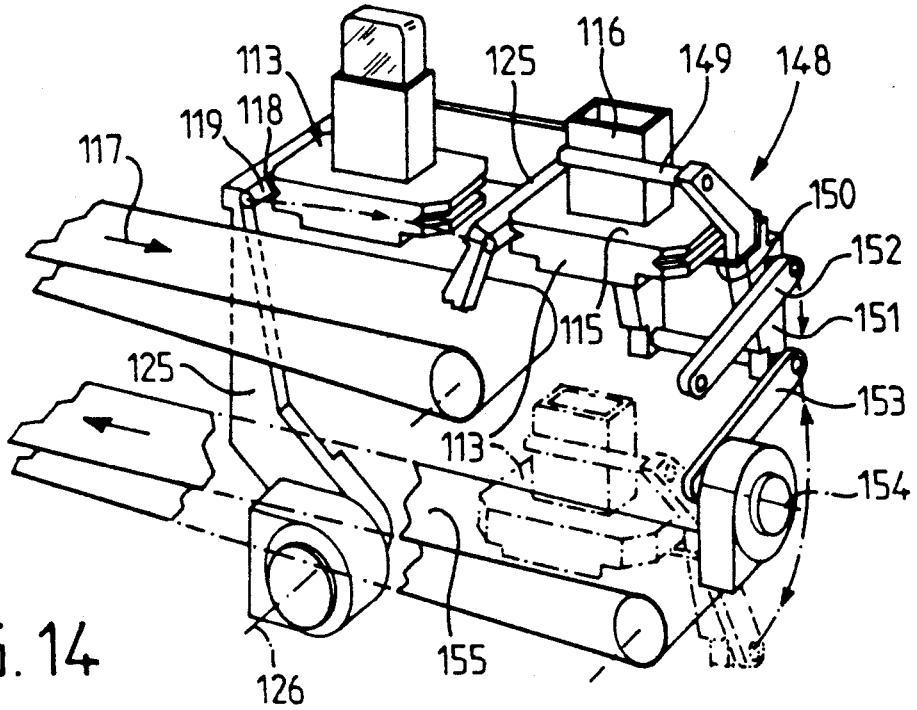
FIG. 14 shows the same end of the conveyor as FIG. 13 and means for fetching the buckets, to permit the vertical transfer of the bottle and the removal of the bucket after the transfer of the bottle.

The horizontal rod 119 (FIG. 14) is integrally joined to the upper end of an arm 125 and is disposed transversely at the edge of the conveyor 112. The arm 125 is mounted for rotation in its lower portion about a horizontal axis 126 parallel to the rod 119, and motive means are provided to control the rotation of the arm 125. When the arm 121 removes the bucket 113 from the conveyor 112, the rod 119 is located in the position farthest to the left, and the bucket 113 is in a position raised by 20 mm. The arm 121 (FIG. 13) can then return to its initial position by a counterclockwise rotation. The bucket 113 containing the bottle 1 is kept spaced apart from the conveyor 112 vertically of the station for introduction of the bottle into the box. The bottom of the bucket 113 is then located above means 127 for introducing the article into the cardboard (FIGS. 16 and 17); for the sake of simplification of the drawing, these means 127 have not been shown in FIG. 14.

The aforementioned means 127 include a jack 128 (FIG. 17) of vertical axis, the rod of which is provided at its upper end with a small horizontal transverse plate 129 arranged to extend underneath the bucket 113 when the bucket is in the introduction station. The small plate 129 is integrally joined with an upwardly extending vertical pusher 130 of rectangular cross section, arranged to engage the inside of the opening 114 in the bottom of the bucket. The small plate 129 is guided in translation by a vertical shaft 131, which for instance is cylindrical, extending downward and offset transversely with respect to the pusher 130. A ramp 132 located in a vertical plane is integrally joined with the small plate 129; this ramp 132 is for example cut in one fin of a vertically oriented angle steel 133 fixed to the small plate 129. The upper end of the ramp 132 is closer to the axis of the shaft 131 than the lower end of this ramp 132.

A lever 134 mounted to rotate at its lower end about a horizontal axis 135 orthogonal to the fin of the angle steel member provided with the ramp 132, is in contact at its rounded upper end with the ramp 132. This lever 134 is integrally joined for rotation with a radial arm 136 (FIG. 16), the end of which remote from the axis 135 is connected via a pivot joint to the lower end of a substantially vertical rocker bar 137, the upper end of which is articulated on a flap integrally joined with a horizontal cross bar 138.

This cross bar 138 is provided on each end with a vertical rod (not visible), which extends through a vertical guide hole provided in a fixed block 139. The portion of each rod included between the cross bar 138 and the lower face of the block 139 is surrounded by a helical compression spring 140. The upper end of each of the rods is integrally joined to a shelf 141 bounded on one long side by a vertical wall in the downward direction, and which on its lower face includes a recess capable of receiving the upper end of the block 139, against which this shelf 141 is normally kept pressed by the action of the springs 140.

The operation of the means 127 for introducing the bottle 1 into the corrugated cardboard 3 and shaper 18 is as follows:

The upward course of the jack 128 brings about the engagement of the pusher 130 with the opening 114 and the cooperation of the inclined portion of the ramp 132 with the upper end of the lever 134. The entire assembly is provided so that this lever 134 will be urged by the ramp 132, before the pusher 130 acts against the bottom of the bottle 1.

Figure 16:
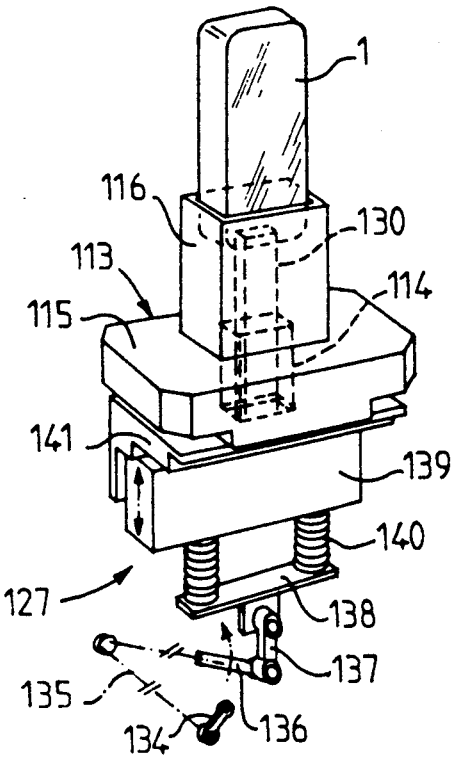
FIG. 16 is a perspective view of a bottle while it is being removed from a bucket, in station IV.
Figure 17:
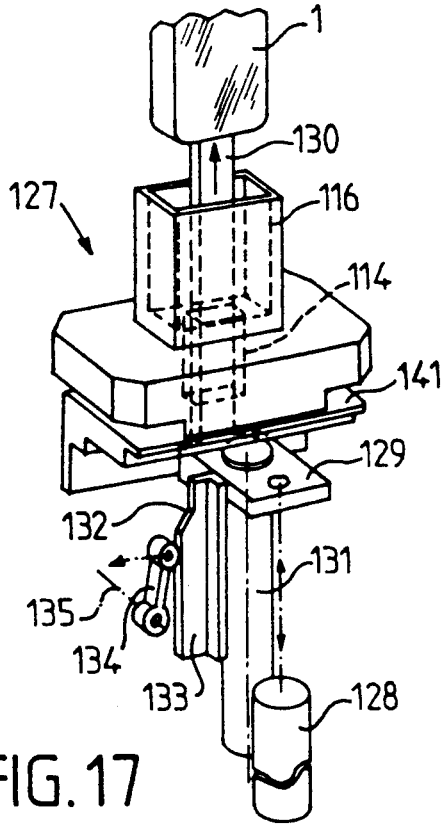
FIG. 17 shows the bottle at the end of the extraction and also shows a portion of the control mechanism.

The lever 134 rotates about the axis 135 counterclockwise in the view of FIG. 17 and drives the rod 136 in the same rotational direction, such that the rocker bar 137 and cross bar 138 are pushed upward, counter to the resistance exerted by the springs 140. The shelf 141 is raised along with the crossbar 138 and moVes aWay from the block 139, as shown in FIG. 16. The movement of the shelf 141 stops when the upper end of the lever 134 has reached the outer edge of the fin of the angle steel 133 that remains at a constant distance from the axis 135. This first phase of the motion makes it possible to simultaneously raise the bottle 1 and the bucket 113, the envelope 116 of which holds the bottle 1 at the moment of its engagement in the upper portion with the inside of the corrugated cardboard 3 and shaper 18, which are not shown in FIGS. 16 and 17 for the sake of simplification of the drawing.

The jack 128 continues its vertical course upward, and the pusher 130 continues to rise, while the tray 115 has stopped its vertical motion. The bottle 1, guided in the upper portion by the corrugated cardboard 3, has completely exited from the envelope 116.

Figure 18:
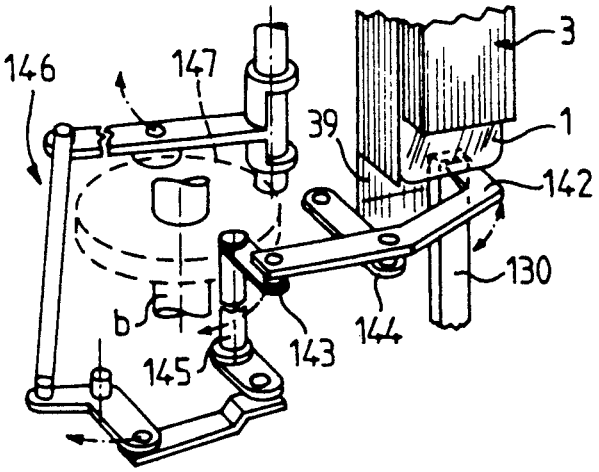
FIG. 18, in perpective, shows a mechanism enabling the support of the bottle at the end of its introduction into the corrugated cardboard.

FIG. 18 shows a retaining slat device 142, provided so as to support the bottle 1 when the bottle has been introduced into the corrugated cardboard envelope 3 (the shaper is not shown in FIG. 18), such that the pusher 130 can be lowered again without causing the lowering of the bottle 1. This slat 142 has one bent end that slides underneath the bottle 1. The movements of the slat 142 are controlled by two rocker bars 143, 144 articulated onto this slat and forming with it a deformable parallelogram, these rocker bars being articulated at their ends remote from the slat 142 about fixed vertical geometric axes.

The rocker bar 143 is driven in rotation about the fixed axis 145 by a mechanism 146 with rods and return levers, controlled by a cam 147 wedged onto the vertical shaft b and against which a cam follower presses that is part of the mechanism 146. When the profile of the cam 147, following the rotation of the cam, moves apart from the cam follower of the shaft b, the slat 142 is displaced in a direction that moves it away from the bottom of the bottle 1; the reverse motion, or in other words the engagement of the slat 142 underneath the bottle 1, is obtained when the profile of the cam 147 makes it possible for the cam follower to approach the shaft b.

When the bottle 1 has been removed from the bucket 113, the arm 125 (FIG. 14) is set into rotation clockwise about the axis 126, in such a way as to move the bucket 113, which no longer contains a bottle, forward.

Means 148 (FIG. 14) are provided to receive the empty bucket 113 at the end of the travel of the arm 125. These means 148 include two rods 149 and 150, of circular cross section and L cross section, respectively, which are parallel to the forward direction of the bucket 113 and are arranged respectively to engage the front of the envelope 116 above the tray 115, and the rear, below this tray 115, in the case of the rod 150.

The two rods 149 and 150 are offset in height and transversely such that the bucket 113 is held by its own weight in contact with these rods, which are affixed at their end opposite the arrival of the bucket 113 to a vertical member 151 comprising one side of a deformable parallelogram, the other sides of which are embodied by parallel rocker bars 152, 153 that are articulated at one of their to this vertical member 151. The other end of each of the rocker bars 152, 153 is articulated about a horizontal axis parallel to the forward direction of the arrow 117. Motive means 154 are provided to control the rotation of the rocker bar 153. A rotation of this rocker bar in the appropriate direction makes it possible to disengage the empty bucket 113 from the rod 119 and lower it to a lower level onto a removal conveyor 155 that is displaced in the direction opposite that of the arrow 117 and drives the bucket 113 by disengaging it from the pickup means 148, since the space between the ends of the rods 149 and 150 remote from the vertical member 151 is free.

Figure 19:
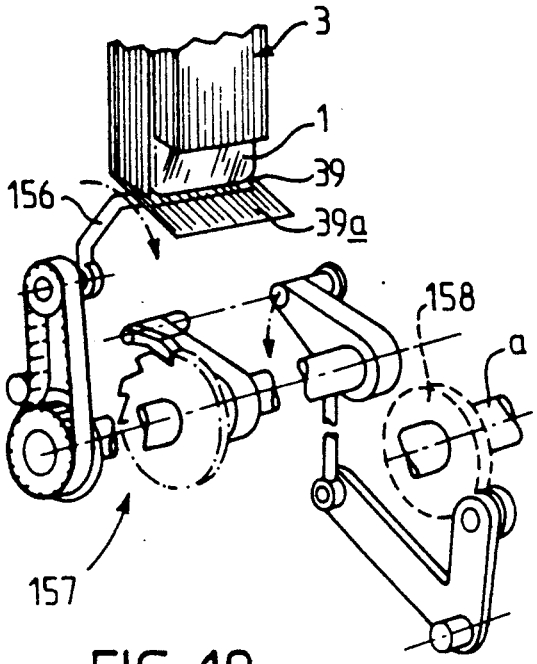
FIG. 19 is a perspective diagram with cutaway portions of a mechanism for creasing the lower flap of the corrugated cardboard, which is also provided in station IV.

Means with a tipping rod 156 to fold the lower flap 39 of the corrugated cardboard 3 down to the horizontal can be seen in FIG. 19. The rod 156, which includes a bent portion, is articulated about a horizontal axis, and its rocking is controlled by a mechanism 157 controlled by a cam 158 wedged for rotation on a horizontal transverse shaft a. The tab **39*a* is located in the extension of the folded down flap 39**.

Figure 20:
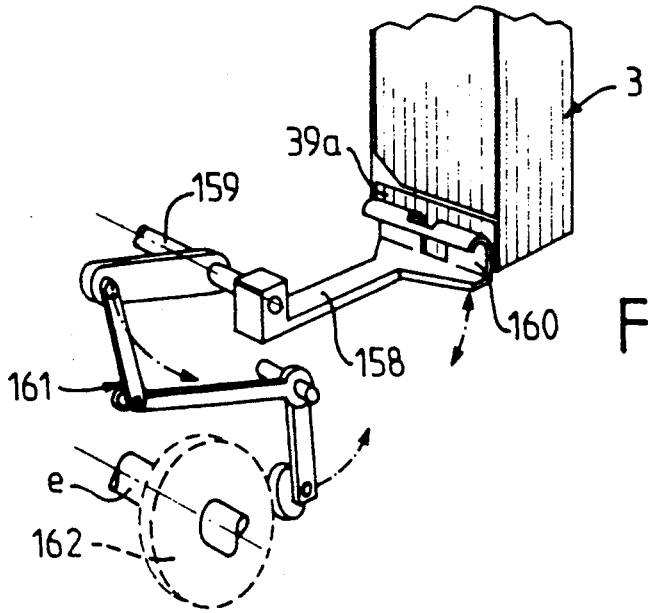
FIG. 20 is a perspective view of a mechanism for folding down the lower tap of the corrugated cardboard, in station V.

FIG. 20 shows an arm 158 arranged to rock about a transverse aXis 159 parallel to the large face of the cardboard 3, the arm 158 forming a folding means arranged to raise the tab **39*a* substantially at a right angle with respect to the bottom of the cardboard. The end 160 of the arm 158 is enlarged and includes a curved upper edge forming a cylindrical portion that is convex toward the top, having generatrices parallel to the axis 159**.

Control of the rocking of the arm 158 is assured by a rod assembly 161 controlled by a cam 162 wedged in rotation onto the shaft e.

Figure 21:
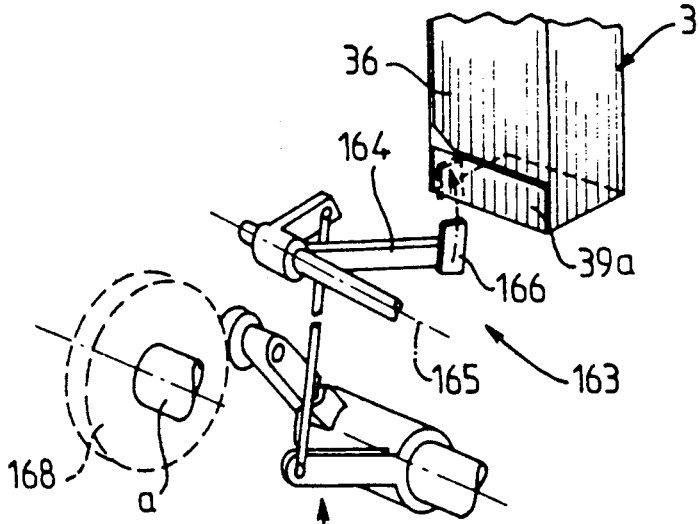
FIG. 21 is a perspective view, with cutaway portions, of a mechanism for lateral holding of the corrugated cardboard, still in station V.

FIG. 21 shows a mechanism 163, also provided at the station V, to keep the face 36 of the cardboard 3 laterally during the folding down of the tab **39*a*. This mechanism 163 includes an arm 164 mounted to rotate about horizontal shaft 165 parallel to the large face of the cardboard 3. The arm 164, at its end radially remote from the axis of rotation, includes a small plate 166 arranged to abut against a lateral wall of the box 3 when the arm 164 is raised. The rotational motion of the arm 164 in a vertical plane is assured by a mechanism 167, shown in FIG. 21, controlled by a cam 168 wedged in rotation onto the horizontal shaft a parallel to the axis 165**.

Figure 22:
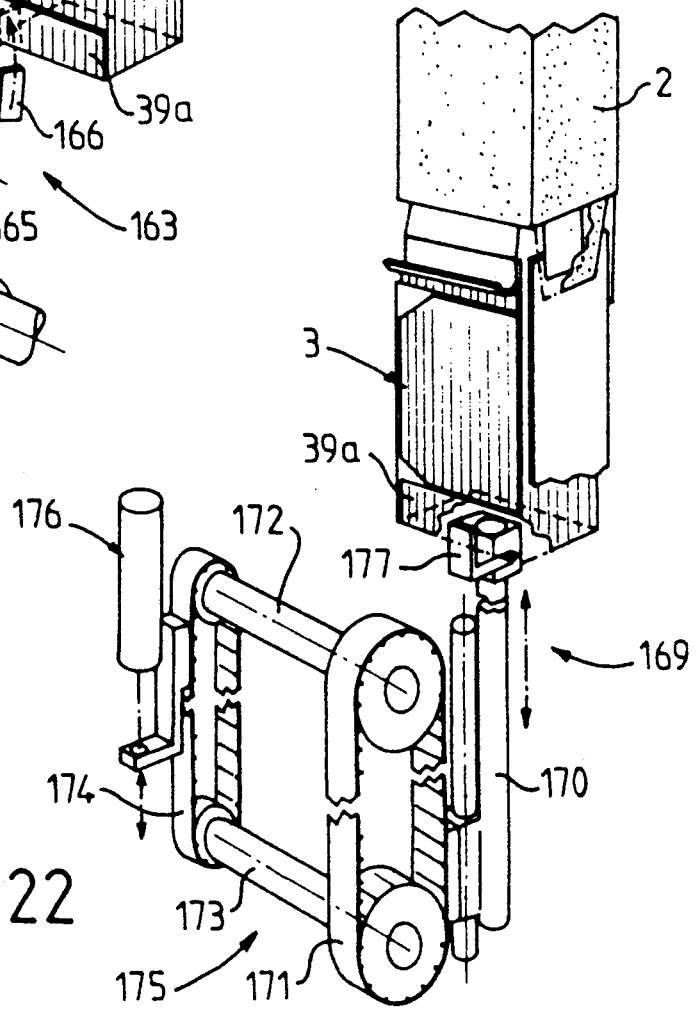
FIG. 22 is a perspective view with cutaway portions of a mechanism for introducing the bottle, surrounded by the corrugated cardboard, into the box by vertical displacement, the mechanism in FIG. 22 being shown at the beginning of the introduction and this mechanism being located at the level of station V.

FIG. 22 shows vertical displacement means 169, provided at the station V, for introducing the bottle, surrounded by the corrugated cardboard 3, into the box 2 that is located above it. These means 169 include a vertically movable pusher 170 driven by a vertical side of a timing belt 171 wound around a closed loop in a vertical median plane about two toothed wheels, of relatively large diameter, that are mounted on two horizontal parallel shafts 172, 173 located at different levels. At another end, these shafts carry pinions of a smaller diameter, cooperating with a timing belt 174 again forming a closed loop with a vertical median plane. It can be seen that the entire mechanism comprising these timing belts, the wheels and the pinions, form a travel amplifying device 175.

Displacement of the belt 174 is controlled by a jack 176 of axial axis, the rod of which is linked in translation with one side of this belt. The upper end of the pusher 170 is provided with a square 177 having a vertical fin that comes to abut the folded down tab **39*a***.

Figure 23:
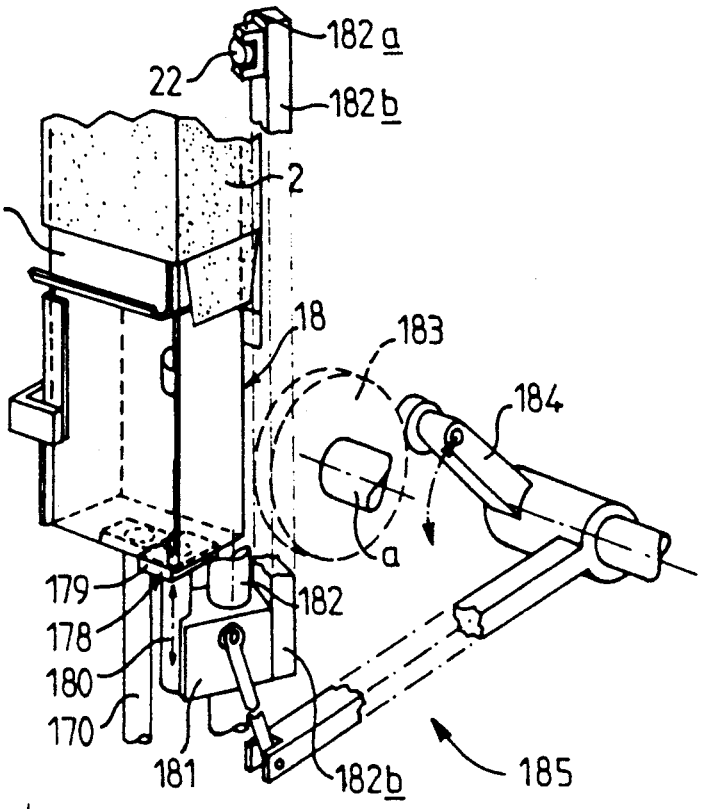
FIG. 23 is a perspective view with cutaway portions of a mechanism, provided at station V, for lowering the shaper.

FIG. 23, still in station V, shows a movable floor device 178 located to the side of the pusher 170 and allowing the passage in the horizontal plane of this pusher. In its upper portion, the device 178 includes a sort of small plate 179 arranged to support the cardboard 3 by pressing against the lower horizontal edge 39 of the cardboard 3. The small plate 179 is carried by a vertical rod 180 that is integral at its lower portion with a block 181 that via a vertical rod 182*b* drives a fork 182*a* that receives the roller 22 of the support 20 of the shaper station including a vertical bore through which a vertical guide column 182 passes. The vertical ascent of the block 18 and hence of the movable floor 178 is controlled by a synchronous action brought about by the roller 22 ascending along the ramp 23 (FIG. 4) and driving the rod 182*b*, and by a cam 183 wedged for rotation on a rotary horizontal shaft a. This cam 183 acts on a roller carried by an arm 184 of a mechanism 185 for motion transmission with an articulated rocker bar, as can be seen in FIG. 23.

When the roller 22 has arrived at the top of the ramp 23, the descent of the block 181, the rod 182*b* and the movable floor 178 is controlled by the means 185.

The movable floor 178 is located in the extension of a fixed ramp (not shown) that supports the shaper 18 with the bottle 1 and the cardboard 3 being supported during the transfer from station IV to station V by the rod 170.

When the pusher 170 at the end of the upward stroke has completed the introduction of the bottle and its cardboard into the box 2, the descent of the rod 180 and of the movable floor 178 is controlled by the means 185, so that the shaper 18 descends again and the upper portion 24 in the form of a funnel is completely disengaged from the box. The bottle remains supported in the box by the pusher 170, which is still in the raised position.

Figure 24:
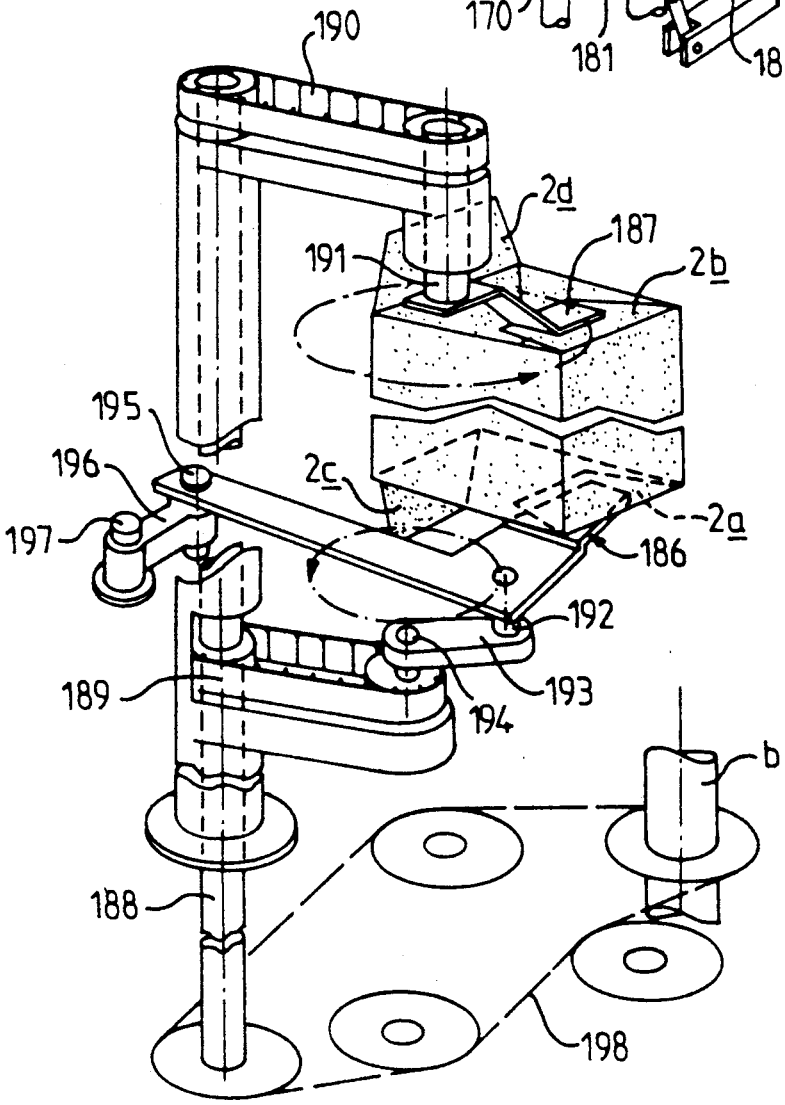
FIG. 24 is a perspective view for cutaway portions of the mechanism to fold down an upper side flap and a lower side flap of the box, provided at station V.

FIG. 24 shows flap folding means with blades 186, 187 that rotate in a substantially horizontal plane and are provided in station V to fold down the lower lateral flap 2*a* and upper lateral flap 2*b* of the box. The blades extend toward the rear in the direction in which the box is driven by the turntable. It will be recalled that for the example being described, in FIG. 24, the direction in which the box 2 is driven is clockwise about the vertical axis of the turntable; that is, the box 2 is driven from right to left in the view of FIG. 24, when the turntable is indexed. The pusher 170 and its upper end are provided to be sufficiently narrow and are located in the median zone of the box 2 so that they do not impede the folding down of the flap 2*a*, 2*b*. Once this folding has been performed, the bottle and the cardboard are kept in the box by the rotary blade 186, such that the pusher 170 can move downward again, so as not to impede the following drive increment of the box 2.

The control of the rotation of the blades 186 and 187 is assured by a vertical rotary shaft 188 that via pinions drives respective timing belts 189, 190. The upper rotary blade 187 is carried by a vertical shaft 191, provided in the upper portion with a pinion driven directly by the belt 190. The lower blade 186 has a substantially square shape; a joint is provided in the vicinity of the top of the square on a vertical axis 192 carried by the radial end of a horizontal crank pin 193. This crank pin is driven in rotation about an axis 194 by a pinion that cooperates with the timing belt 189. The short arm of the blade 186 of the square serves to fold down the flap 2*a*; the long arm of the square 186 is articulated at its end remote from the shaft 192 on a pivot 195 carried by the end of an arm 196 mounted to rotated about a fixed vertical axis 197. This mechanism enables a movement appropriate on the one hand for withdrawing this blade from the path of the box and on the other for folding down the flap 2*a* to be communicated to the blade 186.

The shaft 188 is driven from the vertical shaft b by a system of a chain transmission 198 and return pinions. The two flaps 2*c*, 2*d* of the box located toward the front in the direction of drive of the box will be folded down, at the time this box is displaced, by fixed ramps, not shown, which make it possible to keep these flaps in their folded down position.

Figure 25:
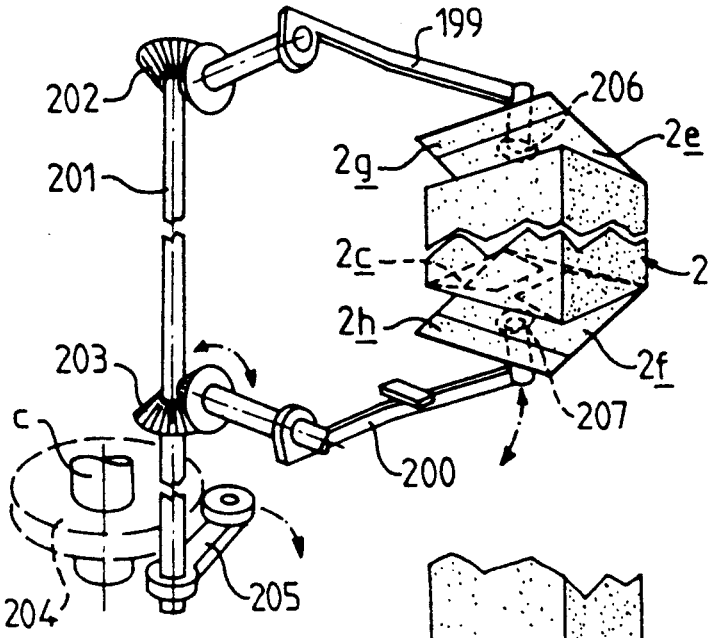
FIG. 25 is a perspective view of a mechanism for folding down the top and bottom of the box at station VI.

FIG. 25 shows a mechanism, provided in station VI, including an upper flap 199 and a lower flap 200 that are mounted to rotate about a horizontal axis. These two flaps are controlled simultaneously by a vertical rotary shaft 201 and by pairs 202, 203 of transmission bevel gears. This assembly is arranged such that for the rotation of the shaft 201 in a predetermined direction, the upper flap 199 is lowered while the lower flap 200 is raised, and the opposite motion is produced by rotation of the shaft 201 in the opposite direction. The rotational motions of the shaft 201 are controlled by a cam 204 wedged onto a vertical shaft c; a radial arm 205 is integrally joined with the shaft 201 in the lower portion and carried a roller capable of pressing against the cam 204 under the influence of elastic restoring means, not shown.

At its end remote from the axis of rotation, each flap 199, 200 is provided with at least one suction device 206, 207 for grasping and closing the top 2*e* and bottom 2*f* of the box, respectively.

Figure 26:
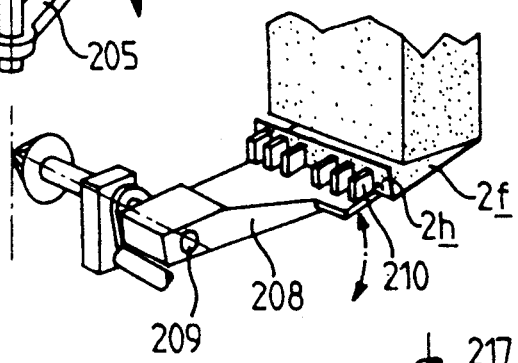
FIG. 26 is a perspective view of a mechanism to fold down the lower tab of the box, at station VI.

FIG. 26 shows an arm 208 combined with the lower flap 200 for folding down the tab 2*h* provided at the edge of the bottom 2*f*. A similar arm (not shown) oriented in the top to bottom direction is combined with the upper flap 199 to fold down the tab 2*g* of the top 2*e*. For the sake of simplifying the drawings, the arm 208 is shown in a drawing FIG. 26 separate from FIG. 25. The arm 208 is mounted to rotate about a horizontal axis 209 and is driven in rotation from the shaft 201 by a bevel gear system shown in fragmentary form. The end of the arm 208 remote from the axis of articulation forms a kind of spatula, the width of which is substantially equal to that of the tab 2*n*; on its upper plane face, this end is provided with teeth 210 formed by a sort of small plates that are parallel to one another and spaced apart from one another and are orthogonal to the plane of the end of the arm 208; the median plane of these small plates is also orthogonal to the fold line of the tab 2*h*. The teeth 210 come to cooperate with the tab 2*h* to assure it folding down substantially by 90° with respect to the bottom 2*f*.

Figure 27:
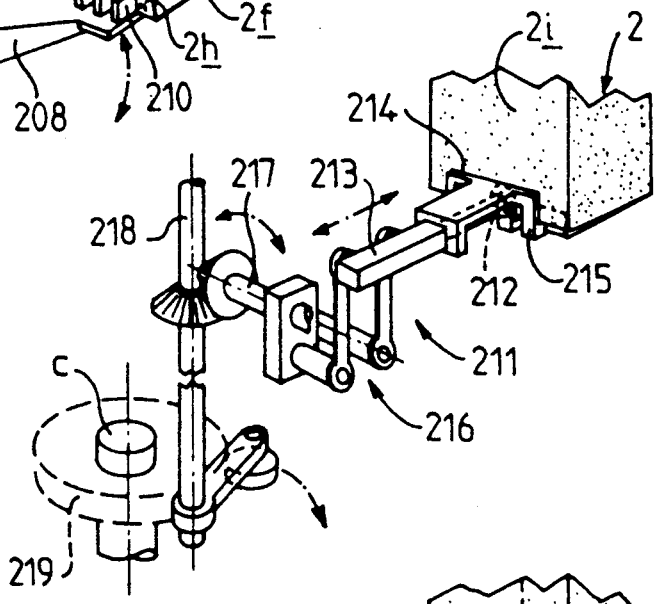
FIG. 27 is a perspective view of a mechanism for holding the front face of the box, to facilitate the introduction of the tab, in station, VI.

FIG. 27 shows means 211 for holding the front wall 2*i* of the box by suction 212, so as to deflect this wall 2*i* slightly, in order to facilitate the introduction of the tab 2*h*. The wall 2*i* is then relaxed.

The means 211 include an arm 213, which for example is tubular with a square cross section and is provided at its end toward the box 2 with a kind of comb or rake 214, the teeth 215 of which are arranged to engage the spaces between the teeth 210 of FIG. 26. Thus the arm 213 is in some way imbricated in the arm 208 when the latter is in the raised position, but for the sake of clarity of the drawings, these two arms have been shown separately in FIG. 26 and 27. The teeth 215 are oriented vertically downward and in their lower portion include one edge projecting toward the box 2 arranged to exert thrust on the tab 2*h* for its introduction into the box. The suction means 212 is provided in the central portion, lacking teeth, of the comb 214; a corresponding free space is provided in the median portion between the teeth 210 (FIG. 26) for the passage of this suction means; by aspiration (creation of a relative vacuum by means not shown in the drawings), the face 2*i* can be pressed against the suction means 212, facilitating the insertion of the tab 2*h*.

The arm 213 is displaced in circular translation, parallel to itself, by a mechanism 216 with articulated rocker bars that form a deformable parallelogram; the two rocker bars are articulated at one of their ends to the arm 213; at its other end, one of the rocker bars is articulated to a fixed point, while the other rocker bar is driven in rotation by a horizontal shaft 217 parallel to the face 2*i* of the box. This shaft 217 is driven from a horizontal shaft 218 by a pair of bevel gears. The vertical shaft 218 is controlled by a cam 219 wedged for rotation onto the shaft c.

A combination of similar means assures the work upon the tab 2*g* of the upper flap of the box.

Figure 28:
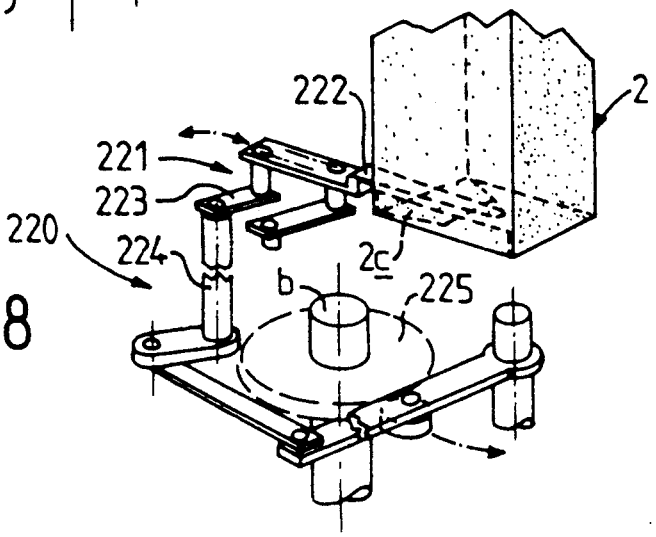
FIG. 28 is a perspective view of a mechanism for control of a slat to hold the lower front flap of the box, still at the level of station VI.

FIG. 28 shows a mechanism 221 provided in station VI, for displacing a slat 222 for retaining the front lower flap 2*c* of the box. When the tab 2*h* has been introduced into the box 2 and is locked in a conventional manner, the bottom 2*f* of the box no longer threatens to come open under the influence of the weight of of the bottle, and the slat 222 can then be retracted and withdrawn to permit the ensuing indexing of the box 2 by the turntable (not visible in FIG. 28)

The slat 222, which has a portion bent at right angles, is displaced in circular translation parallel to itself by a system 223 with two horizontal rocker bars forming a deformable parallelogram. The rotation of one of the rocker bars is controlled by a vertical shaft 224, which in turn is controlled by a cam 225 wedged onto the vertical shaft b and acting on a linking mechanism visible in FIG. 28.

Figure 29:
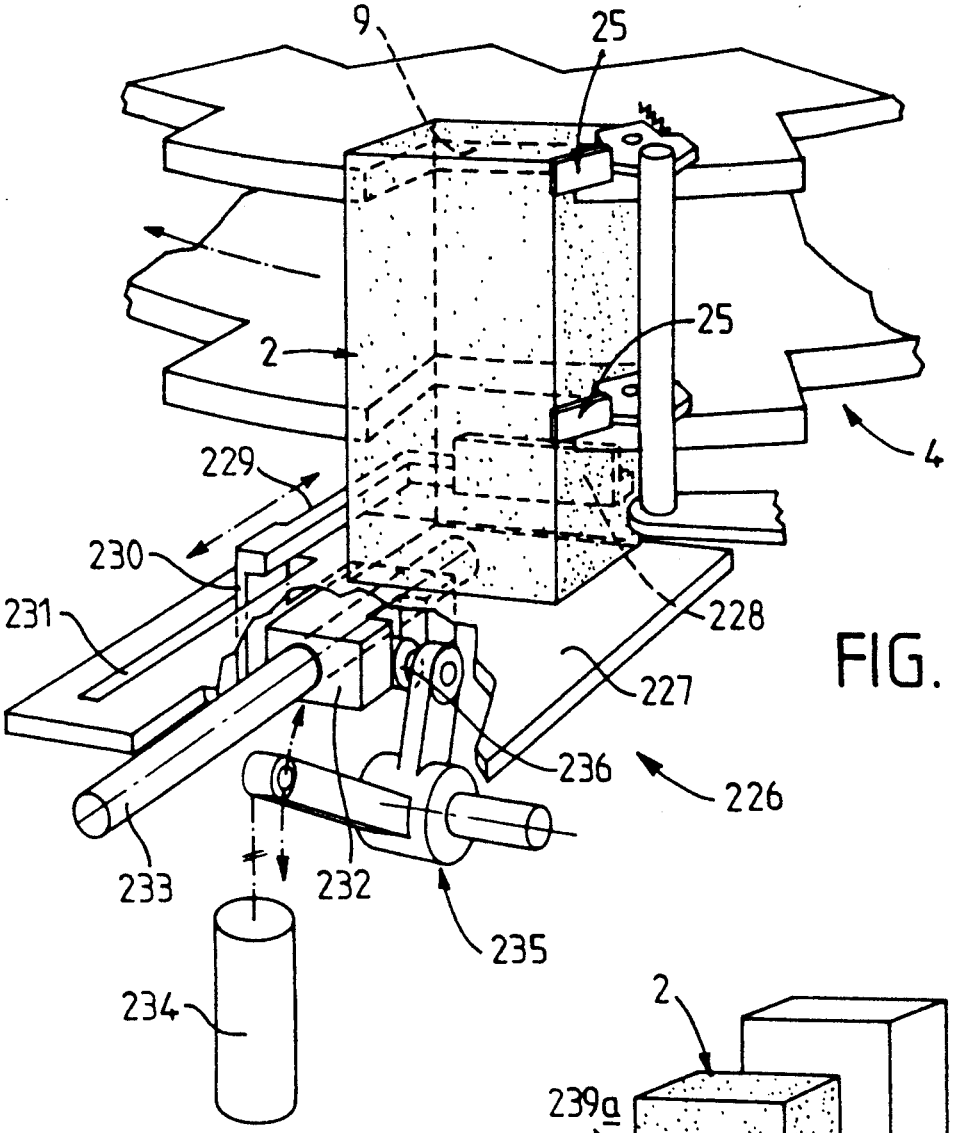
FIG. 29 is a perspective view with cutaway portions of a mechanism for ejecting the box, at station VIII.

FIG. 29, at the level of the station VIII, shows part of the turntable 4 and of means 226 for ejecting the box 2, which has been closed and filled with the bottle 1 surrounded by its cardboard and held in the receptacle 9, from the turntable.

The means 26 include a tray 227 extending radially outward, and the upper surface of which is tangent to the lower portion of the box 2. A pusher 228 is provided radially inward, so as to extend transversely behind the large inner face of the box 2. This pusher 228 is fixed to a horizontal transverse leg of a traction device 229 in the form of a square, the other leg of which is radially oriented. The concavity of this device 229 faces in such a way as to be capable of receiving the base of the box 2 when the box turns clockwise, driven by the turntable 4. The radial leg of the part 229 is provided with a vertical extension 230 pointing downward, at its end remote from the pusher 228. This extension passes through a longitudinal slit 231 provided in the tray 227. The extension 230 is linked in translation, beneath the tray 227, to a block 232 mounted to slide on a radially oriented guide rod 233 that passes, with reduced play, through a hole made in the block 232. The translational displacement of the block 232 is controlled by a jack 234 having a vertical axis, the rod of which is connected at its free end, via a joint, to one leg of a return device 235 mounted to rotate about a horizontal axis, having a direction orthogonal to that of the rod 233. The return device 235 includes another leg, offset substantially by 90° with respect to the leg connected to the rod of the jack 234; at its end, this other leg carries a roller 236 that engages a vertical lateral notch in the block 232.

A rotation in an appropriate direction of the return device 235 brings about the translational displacement of the block 232 radially outward, such that the pusher 228 drives the box 2 outside the turntable 4. The turntable, having caused the opening of the clips 25 at the end of its rotation, forces them open onto a fixed bar.

Figure 30:
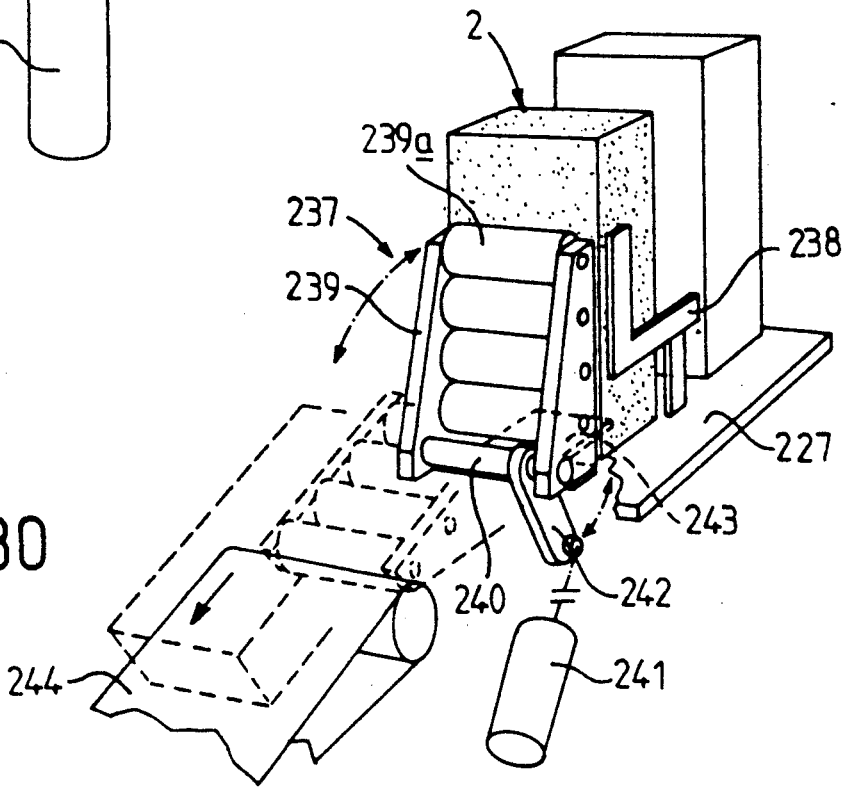
FIG. 30 is a perspective view of a tipping assembly that follows the box ejection means, at station VIII.

FIG. 30 shows a tipping assembly 237, which is provided in station VIII at the outer radial end of the tray 227.

The assembly 237 includes a framework 239 that can rock about a transverse horizontal shaft 240, the geometric axis of which is located substantially in the median plane of the tray 227 The rocking of the framework 239 is controlled by a jack 241, the free end of the rod of which is articulated on the end of a rocker bar 242, which is orthogonal to the shaft 240 and connected for rotation with it.

The framework 239 includes two vertical members at the sides, in the form of an isosceles trapezoid, which is orthogonal to the tray 227 and turns toward the box 2 when the framework 239 is in the raised position shown in FIG. 30.

Rollers 239*a*, for example four in number, with parallel horizontal axes are disposed side by side between the vertical members of the framework 239; the rollers 239*a* can rotate freely about their axes carried by said vertical members. A guide and holding element 238 in square form is affixed to the tray 227 for the lateral positioning of the box 2 with respect to the framework 239.

The framework 239 includes a small plate 243 forming a square with the median plane of the axes of the rollers and integrally joined to the vertical members of the framework 239. When this framework is in its raised position as shown in FIG. 30, the small plate 243 enters into an opening in the tray 227; when the box 2 is pushed into contact with the rollers 239*a*, the plane of the axes of which is vertical, the small plate 243 is located beneath the bottom of the box 2.

When the jack 241 controls the rocking forward of the framework 239, the small plate 243 drives the box 2 in this rocking motion. The rocking is controlled until the plane of the axes of the rollers 239*a* is slightly inclined with respect to the horizontal, in such a way as to assure the removal by gravity of the box 2 onto a conveyor 244.

This removal takes place at a reduced speed and without any impact.

The functioning of the machine according to the invention will be apparent from the foregoing explanation, so that its further description here will be unnecessary.

It will be recalled simply that the turntable 4 rotates in increments such that the receptacles of the turntable pass successively to the stations I–VIII and stop there.

In station I, the machine assures the pickup of the cardboard 3 in the storage device and introduction of the cardboard into the shaper 18, with folding of the lateral walls and upper and lower portions, as well as of the front flap.

In station II, a box 2, taken flat from the stack, is opened up to make the actual box and is introduced into a receptacle 9 of the turntable.

In station III, the ascent of the cardboard and of the shaper is begun by the ramp 23.

In station IV, the bottle is introduced into the cardboard, the empty bucket that contained the bottle is ejected, and the lower flap of the cardboard is folded down.

In station V, the tab located at the edge of the lower flap of the cardboard is folded down, the combined bottle and cardboard are introduced into the box 2, and then the shaper 18 is lowered; the lower and upper rear lateral flaps of the box 2 are folded down, and then the pusher of the bottle is lowered. The other lateral flaps of the box 2 are then folded down. In station VI, the end flaps of the box are folded fown, with the tabs being driven home into the box, by the combined action of pushers and suction devices.

In station VII, the closed box does nothing but move past.

In station VIII, the box is ejected.

The automatic cartoning machine according to the invention may be made in a compact form, with a footprint or area on the floor of approximately 0.7 m×0.85 m, for a total height of 1.35 m, and can assure a speed on the order of 10 to 20 strokes per minute. The machine is simple in design and enables very rapid changes in size, obtained not only by adjustments but also by tool changes that are easy to accomplish. Synchronization is obtained with the aid of cams mounted on rotary shafts driven by the same motor, which is an economical and sturdy solution. The article, in particular the bottle 1, is always handled in its natural position, without any grasping system, and without the necessity of imparting shocks or bumping it in any way. The boxes are closed at the last moment, which virtually completely precludes the risk of scratching of the boxes.

What is claimed is:

1. An apparatus for automatically placing an article into a container means comprising a turntable mounted to rotate about a substantially vertical axis in a plane defining a first level, said turntable having a plurality of receptacle means distributed about the periphery thereof each for receiving a container means in an open condition during movement past a first work station and for moving each container means incrementally through a plurality of successive work stations upon rotation of said turntable, a second level spaced vertically from said first level, means at said second level for moving an article vertically relative to a container means at one of said work stations, means for displacing the article at another work station vertically into the container means, a third level disposed intermediate said first and second levels and including means for supplying a sheet of wrapping material from a supply means for the sheets to sheet shaping means disposed at said third level for delivery to a corresponding receptacle means, said second level being disposed below said first level and said means for displacing operating to vertically raise the article for introduction into the container means, said receptacle means having a lower portion and said sheet shaping means including guide means extending from adjacent said third level to said lower portion of said receptacle means, said shaping means including contact means for engaging a ramp means for maintaining vertical movement of said shaper means, said shaping means being movable along said ramp means between said third and first levels for introduction into the container means.

2. The apparatus as claimed in claim 1 wherein the container means is a box and said apparatus includes means for storage of the boxes in a folded, flat condition, box grasping means for grasping a folded, flat box and passing the folded box along a path to a said receptacle means of said turntable, ramp means for engaging at least one edge of the folded box while said box is being moved along said path to thereby unfold the flat box to a substantially rectangular shape with edge flaps extending from an upper portion and a lower portion of said unfolded box, said box grasping means being mounted on a carriage that is movable rectilinearly from the box supply means to a point adjacent a receptacle of said turntable.

3. An apparatus for automatically placing an article into a container means comprising a turntable mounted to rotate about a substantially vertical axis in a plane defining a first level, said turntable having a plurality of receptacle means distributed about the periphery thereof each for receiving a container means in an open condition during movement past a first work station and for moving each container means incrementally through a plurality of successive work stations upon rotation of said turntable, a second level spaced vertically from said first level, means at said second level for moving an article vertically relative to a container means at one of said work stations, means for displacing the article at another work station vertically into the container means, a third level disposed intermediate said first and second levels and including means for supplying a sheet of wrapping material from a supply means for the sheets to sheet shaping means disposed at said third level for delivery to a corresponding receptacle means, said container means being a box and said apparatus including means for storage of the boxes in a folded, flat condition, box grasping means for grasping a folded, flat box and passing the folded box along a path to a said receptacle means of said turntable, ramp means for engaging at least one edge of the folded box while the box is being moved along said path to thereby unfold the flat box to a substantially rectangular shape with edge flaps extending from an upper portion and a lower portion of said unfolded box, said box grasping means being mounted on a carriage that is movable rectilinearly from the box supply means to a point adjacent a receptacle of said turntable, said carriage being mounted for rectilinear motion between said box supply means and said turntable along a rectilinear slide, said apparatus further including a timing belt having means for periodically engaging said slide to effect said translation, transmission means for alternately rotating said belt in one sense and then in an opposite sense, said transmission means comprising a wheel including a pinion connected to cam follower means, and a rotatable cam for intermittently imparting rectilinear motion to said cam follower means.

4. An apparatus for automatically placing an article into a container means comprising a turntable mounted to rotate about a substantially vertical axis in a plane defining a first level, said turntable having a plurality of receptacle means distributed about the periphery thereof each for receiving a container means in an open condition during movement past a first work station and for moving each container means incrementally through a plurality of successive work stations upon rotation of said turntable, a second level spaced vertically from said first level, means at said second level for moving an article vertically relative to a container means at one of said work stations, means for displacing the article at another work station vertically into the container means, a third level disposed intermediate said first and second levels and including means for supplying a sheet of wrapping material from a supply means for the sheets to sheet shaping means disposed at said third level for delivery to a corresponding receptacle means, said shaper means having, in use, an upper portion including movable panels extending from said upper portion, said panels converging toward each other to facilitate entry of said panels into the container means.

5. The invention as claimed in claim 4 wherein said shaper means comprises a rear wall having edges and a side wall extending from each edge to define a cage for receiving one of the sheets of wrapping material, said upper portion including an edge member extending from one side wall to the other side wall, a lower portion, said upper and lower portions each being open, said means for supplying including grasping means for grasping a sheet from said supply means and inserting a grasped sheet into said cage and for pressing the sheet against said rear wall, the sheet being of a size relative to said cage such that said side walls and said edge member cooperate to retain the inserted sheet in said cage, the sheet also including front and bottom side flap portions and flap folding means being provided to fold the front and bottom side flap portions after insertion of a sheet into said cage.

6. The invention as claimed in claim 5 wherein said grasping means includes a suction device rotatably supported on a vertical shaft, said vertical shaft for said suction device including a base having a guide block mounted on a guide track which is carried on a rotatably mounted support member for rotation about a vertical axis, means for translating said vertical shaft along said guide track in timed relationship with the rotation of said support member.

7. The invention as claimed in claim 6 wherein the means for moving the vertical shaft of said suction device includes a horizontal arm disposed above said support member and provided with a vertical sleeve surrounding said shaft while allowing free relative rotation between said shaft and said sleeve, a driving arm being provided for transmitting motion to said sleeve, said driving arm being rotatably connected to a rotatable drive shaft which extends coaxially with said support member, transmission means being provided for transmitting rotary motion of said drive shaft to said driving arm and to said support member.

8. The invention as claimed in claim 7 wherein means for driving said drive shaft first in one direction and then in an opposite direction are provided, said driving means including a drive wheel having adjacent its periphery a pinion connected to a cam follower and a rotary cam for intermittently imparting rectilinear movement to said cam follower.

9. An apparatus for automatically placing an article into a container means comprising a turntable mounted to rotate about a substantially vertical axis in a plane defining a first level, said turntable having a plurality of receptacle means distributed about the periphery thereof each for receiving a container means in an open condition during movement past a first work station and for moving each container means incrementally through a plurality of successive work stations upon rotation of said turntable, a second level spaced vertically from said first level, means at said second level for moving an article vertically relative to a container means at one of said work stations, means for displacing the article at another work station vertically into the container means, a third level disposed intermediate said first and second levels and including means for supplying a sheet of wrapping material from a supply means for the sheets to sheet shaping means disposed at said third level for delivery to a corresponding receptacle means, said means for displacing the article at another work station vertically into the container means comprising a pusher member mounted for vertical movement, travel amplifying means connected to said pusher means and jack means for actuating said travel amplifying means, said apparatus further including extraction means for receiving said shaping means upon removal of the article and the sheet of wrapping material from said shaping means into the container means.

10. An apparatus for automatically placing an article into a container means comprising a turntable mounted to rotate about a substantially vertical axis in a plane defining a first level, said turntable having a plurality of receptacle means distributed about the periphery thereof each for receiving a container means in an open condition during movement past a first work station and for moving each container means incrementally through a plurality of successive work stations upon rotation of said turntable, a second level spaced vertically from said first level, means at said second level for moving an article vertically relative to a container means at one of said work stations, means for displacing the article at another work station vertically into the container means, a third level disposed intermediate said first and second levels and including means for supplying a sheet of wrapping material from a supply means for the sheets to sheet shaping means disposed at said third level for delivery to a corresponding receptacle means, said container means being a box and said apparatus including means for storage of the boxes in a folded, flat condition, box grasping means for grasping a folded, flat box and passing the folded box along a path to a receptacle means of said turntable, ramp means for engaging at least one edge of the folded box while said box is being moved along said path to thereby unfold the flat box to a substantially rectangular shape with edge flaps extending from an upper portion and a lower portion of said unfolded box, said box grasping means being mounted on a carriage that is movable rectilinearly from the box supply means to a point adjacent a receptacle of said turntable, said apparatus including blade engaging means for engaging and rotating a formed box in a substantially horizontal plane to fold the lower and upper side flaps of the box as the box is moved past said blade engaging means by said turntable.

11. An apparatus for automatically placing an article into a container means comprising a turntable mounted to rotate about a substantially vertical axis in a plane defining a first level, said turntable having a plurality of receptacle means distributed about the periphery thereof each for receiving a container means in an open condition during movement past a first work station and for moving each container means incrementally through a plurality of successive work stations upon rotation of said turntable, a second level spaced vertically from said first level, means at said second level for moving an article vertically relative to a container means at one of said work stations, means for displacing the article at another work station vertically into the container means, a third level disposed intermediate said first and second levels and including means for supplying a sheet of wrapping material from a supply means for the sheets to sheet shaping means disposed at said third level for delivery to a corresponding receptacle means, said apparatus further including a supply conveyor for the articles to be introduced into the container means, said apparatus further including a bucket for an article and having a bottom having an opening, said apparatus further including means for picking up a said bucket from said supply conveyor and for moving the bucket to a position adjacent a work station for introduction of the article into said shaper means.

12. The apparatus as claimed in claim 11 wherein said picking up means includes arm means for raising the bucket with an article therein while maintaining said bucket in a substantially upright condition and pusher means are provided for insertion through said opening in said bottom of said bucket for moving the article from said bucket into said shaper means.

13. The apparatus as claimed in claim 12 wherein adjacent said shaper means, a retaining device is provided to engage the bottom of the article after the article has been introduced into said shaper means, said apparatus further including a tipping rod means positioned to fold the lower flap of the sheet in the shaping means to a substantially horizontal position and to support said lower flap with the article resting thereon after withdrawal of said retaining device.

14. An apparatus for automatically placing an article into a container means comprising a turntable mounted to rotate about a substantially vertical axis in a plane defining a first level, said turntable having a plurality of receptacle means distributed about the periphery thereof each for receiving a container means in an open condition during movement past a first work station and for moving each container means incrementally through a plurality of successive work stations upon rotation of said turntable, a second level spaced vertically from said first level, means at said second level for moving an article vertically relative to a container means at one of said work stations, means for displacing the article at another work station vertically into the container means, a third level disposed intermediate said first and second levels and including means for supplying a sheet of wrapping material from a supply means for the sheets to sheet shaping means disposed at said third level for delivery to a corresponding receptacle means, said container means being a box and said apparatus including means for storage of the boxes in a folded, flat condition, box grasping means for grasping a folded, flat box and passing the folded box along a path to a receptacle means of said turntable, ramp means for engaging at least one edge of the folded box while said box is being moved along said path to thereby unfold the flat box to a substantially rectangular shape with edge flaps extending from an upper portion and a lower portion of said unfolded box, said box grasping means being mounted on a carriage that is movable rectilinearly from the box supply means to a point adjacent a receptacle of said turntable, said apparatus including blade engaging means, said box including an upper flap and a lower flap and flap closing means for each of said flaps being provided and including a suction device for engaging an associated flap and moving the associated flap to close said box, each said suction device being mounted on an arm with each said arm being pivotally mounted to move said suction device in a direction to close said associated flap, each said flap terminating in a tab portion and said apparatus including means for folding and inserting said tab portion into said box as said flap is closed.

15. The apparatus as claimed in claim 14 wherein deflecting means are provided for engaging and deflecting the front wall of said box outwardly to facilitate introduction of said tabs of said flaps.

16. An apparatus for automatically placing an article into a container means comprising a turntable mounted to rotate about a substantially vertical axis in a plane defining a first level, said turntable having a plurality of receptacle means distributed about the periphery thereof each for receiving a container means in an open condition during movement past a first work station and for moving each container means incrementally through a plurality of successive work stations upon rotation of said turntable, a second level spaced vertically from said first level, means at said second level for moving an article vertically relative to a container means at one of said work stations, means for displacing the article at another work station vertically into the container means, a third level disposed intermediate said first and second levels and including means for supplying a sheet of wrapping material from a supply means for the sheets to sheet shaping means disposed at said third level for delivery to a corresponding receptacle means, said apparatus further including means for discharging a filled box from said turntable and for delivering the filled box to a tipping assembly having a plate member for engaging the bottom surface of the closed box, said tipping assembly further including a plurality of rollers, the axes of which all extend parallel to one another and which are mounted on frame means with said frame means being pivotable about one end thereof to effect lifting and pivoting of a box carried by said plate whereupon said box will be free to slide on said rollers to a discharge position.

* * * * *